US005161350A

United States Patent [19]

Nakamura

[11] Patent Number: 5,161,350

[45] Date of Patent: Nov. 10, 1992

[54] PROCESS AND APPARATUS FOR MANUFACTURING A DISPENSER-CONTAINER

[75] Inventor: Kenji Nakamura, Osaka, Japan

[73] Assignee: Kennak U.S.A. Inc., New York, N.Y.

[21] Appl. No.: 705,519

[22] Filed: May 24, 1991

Related U.S. Application Data

[62] Division of Ser. No. 433,514, Nov. 8, 1989, Pat. No. 5,048,718.

[30] Foreign Application Priority Data

Nov. 9, 1988 [JP] Japan ..... 63-283500
Feb. 17, 1989 [JP] Japan ..... 1-38549

[51] Int. Cl.[5] ..... B65B 9/02; B65B 9/06; B65B 9/10; B65B 61/18

[52] U.S. Cl. ..... 53/412; 53/449; 53/450; 53/462; 53/474; 53/133.4; 53/133.8; 53/550; 53/553; 53/171

[58] Field of Search ..... 53/412, 449, 450, 462, 53/474, 550, 133.4, 133.8, 553, 171, 172

[56] References Cited

U.S. PATENT DOCUMENTS

| | | | |
|---|---|---|---|
| 2,008,659 | 7/1935 | Salfisberg | 53/450 X |
| 2,917,164 | 12/1959 | Kehr | 383/40 X |
| 2,952,398 | 9/1960 | Gerard | 383/39 X |
| 3,338,019 | 8/1967 | Trewella et al. | 53/412 |
| 3,653,502 | 4/1972 | Beaudoin | 53/412 X |
| 3,940,904 | 3/1976 | McGuire et al. | 53/412 X |
| 3,940,905 | 3/1976 | Perry, 3rd. | 53/412 |
| 4,185,754 | 1/1980 | Julius | 53/412 X |
| 4,538,396 | 9/1985 | Nakamura | 53/412 |
| 4,616,470 | 10/1986 | Nakamura | 53/412 |
| 4,653,250 | 3/1987 | Nakamura | 53/412 |
| 4,840,270 | 6/1989 | Caputo et al. | 206/205 |
| 4,995,217 | 2/1991 | Francis, Jr. | 53/449 X |

FOREIGN PATENT DOCUMENTS

| | | | |
|---|---|---|---|
| 2439511 | 3/1975 | Fed. Rep. of Germany | 53/412 |

*Primary Examiner*—Horace M. Culver
*Attorney, Agent, or Firm*—Brooks Haidt Haffner & Delahunty

[57] ABSTRACT

A dispenser-container comprises a container body provided with two containing spaces, containing wet contents and dry contents, respectively. The container body is a bag constituted by a first flexible sheet made of a liquid impervious material and a second flexible sheet made of a liquid impervious material. The first sheet constitutes a bag of a pillow type, longitudinal edges of the first sheet overlap each other and are at most slightly sealed with each other to such an extent that they can be manually separated to form an opening for dispensing the dry contents. The second sheet is fixed to the first sheet along the entire peripheries thereof and is located outside or inside the pillow type bag. The first sheet or the second sheet has an opening or a weakened line for forming the opening, to permit dispensing of the wet contents, at a position forming a surface of the container body and being opposite to the overlapping longitudinal edges of the first sheet, and has a flexible flap for resealably covering the opening for dispensing the wet contents. The wet contents are contained in one of the containing spaces, formed between the first sheet and the second sheet and provided with the resealable flap.

23 Claims, 12 Drawing Sheets

30A
30
51A
11
51
36
17
17a
16
35A
35
4
33
34A
17A
36A
37
17b
37A
13
12
52
52A
20
14
42
21
42A
14
33A
34
38
38A
43A
22
43
5
9
32
32A
13
40A
15
40
21
16
41A
41
16A
100
4
15

PROCESS AND APPARATUS FOR MANUFACTURING A DISPENSER-CONTAINER

This application is a division of application Ser. No. 07/433,514, filed Nov. 8. 1989, now U.S. Pat. No. 5,048,718.

BACKGROUND OF THE INVENTION

1. Field of the Invention

The present invention relates to a portable dispenser-container containing contents in a wet condition and contents in a dry condition, such as wet tissues and dry tissues. More specifically, the present invention relates to a portable dispenser-container, from which the wet tissues and the dry tissues contained therein can be individually dispensed one by one, and especially, it can be repeatedly opened and resealed for wet tissues required to be hermetically sealed.

2. Description of the Prior Art

Recently, wet tissues, i.e., fibrous materials impregnated with cleaning solution such as alcohol, have been utilized widely for cleaning dirt from hands or other body portions. Such wet tissues packed in a cylindrical container are used at home or shops, and wet tissues contained in a small dispenser-container are sold for portable use and are widely used.

Although wet tissues are convenient for cleaning skin or make up, their usage has been limited since they are in a wet condition. In other words, in some cases, they cannot be used in place of dry tissues. Accordingly, it is necessary for users to take dry tissues as well as wet tissues in the outdoors.

Either the wet tissues or the dry tissues may often be left behind, if a user wants to have both a small dispenser-container of wet tissues and a small dispenser-container of dry tissues. Accordingly, a portable pack wherein both wet tissues and dry tissues are available is convenient.

An example of such a portable pack is disclosed in Japanese Utility Model Publication No. Sho 57-60399. In the pack disclosed in this publication, wet tissues and tissue paper are contained in a bag-like pack made of a water impervious resin film in such a manner that both the tissues are laterally in parallel, and the central portion of the pack between the wet tissues and the tissue paper and the peripheries of the pack are heat sealed. The pack is intended to be folded at the heat sealed central portion.

Since the portable pack disclosed in the above-described Japanese Utility Model Publication No. Sho 57-60399 has a construction as described above, the industrial manufacture of the pack is difficult.

More specifically, when the portable pack disclosed in Japanese Utility Model Publication No. Sho 57-60399 is intended to be manufactured, wet tissues and tissue paper have to be laid on a lower resin film while they are laterally in parallel, and an upper resin film provided with dispensing openings for the wet tissues and the tissue paper is supplied onto the laid wet tissues and tissue paper, and then the central portion between the wet tissues and the tissue paper and the peripheries of the pack are heat sealed to form a bag.

However, in such a manufacturing process, when the wet tissues and tissue paper are laid on a lower resin film while they are laterally in parallel, liquid with which the wet tissues have been impregnated may leak or flow out, and the adjacent tissue paper may be wetted and deteriorated.

In addition, portions to be heat sealed on the resin film may also be wetted, and the heat sealing may be difficult.

Although the peripheries of the pack can be heat sealed with relatively ease, heat sealing at the central portion between the wet tissues and the tissue paper can not be done well unless the positions of the wet tissues and the tissue paper are precise. Accordingly, the wet tissues and the tissue paper must be precisely supplied to the predetermined positions on the lower film, and the displacement of the materials must be prevented while they are transferred to the sealing station. These steps require very complicated control and adjustment, and in actual fact, satisfaction of these requirements is very difficult. Thus, continuous manufacture of such packs is practically impossible.

In an alternative process for manufacturing the above-described packs, a bag with one open side is prepared by sealing three peripheries of the pack and the central portion, and after the wet tissues and the tissue paper are inserted into the bag through the open side, the open side is heat sealed to form a portable pack.

However, it is difficult to automatically insert tissues, especially wet tissues, into the bag, and accordingly, continuous manufacture of the packs is impossible. Accordingly, the cost of the above-described pack is expensive.

In addition, the portable pack disclosed in the above-described Japanese Utility Model Publication No. Sho 57-60399 is a four-sided seal pack, wherein the peripheries of the three sheets are sealed together, the pack having hard peripheries. Accordingly, it is not easy for a user to handle the pack since the hard portions in the pack may contact the user's hand. Further, the size of the pack may be voluminous depending upon the size of the sealed peripheries as compared with the total size of the contents and the necessary tolerances.

Further, the portable pack disclosed in the above-described Japanese Utility Model Publication No. Sho 57-60399 is folded at the heat sealed central portion when it is carried. However the pack as a whole is bulky because the wet tissues, the tissue paper and the four thick films are stacked and because the folded portion has a tendency to open. Thus, a compact dispenser-container for portable use is required.

The present applicant previously proposed in Japanese Patent Publication No. Sho 58-41842 a dispenser-container, wherein three sheets are used, two of which are used to provide a bag and the other of which is used to provide a partition, and are superposed, and the four peripheries of the sheets are sealed while the dry contents and wet content, sandwiching the partition therebetween, are inserted into spaces between the sheets.

Since the portable pack disclosed in the above-described Japanese Patent Publication No. Sho 58-41842 is a four-sided seal pack wherein the peripheries of the three sheets are sealed together, the pack has hard peripheries. Accordingly, it is not easy for a user to handle the pack since the hard portions in the pack may contact the user's hand. Further, the size of the pack may be voluminous as determined by the size of the sealed peripheries as compared with the total size of the contents and the necessary tolerances.

When the dispenser-container disclosed in Japanese Patent Publication No. Sho 58-41842 is manufactured, the contents in a dry condition are disposed on a sheet-like material, and then, a sheet-like material for the partition is laid over the contents, and thereafter, the contents in a wet condition are disposed on the sheet-like material used for the partition. In such a stacked condition, the peripheries of the three sheets are heat sealed. Since the two kinds of contents are stacked via a partition or since the three sheets are simultaneously heat sealed while the two kinds of contents are sandwiched therebetween as described above, adjustment for continuous manufacture is relatively complicated. Especially, when the thickness of the contents is large, the stacked contents may be displaced. Accordingly, in this case, it is necessary to enlarge the sizes of the sheets relative to the contents contained in the pack. Therefore, it is difficult to obtain compact dispenser-containers.

In addition, the present applicant proposed in Japanese Patent Application Laid-open No. Sho. 61-203305 a method of producing a dispenser-container containing two kinds of contents, wherein the first contents, for example the contents containing the wet materials, are contained in an inner container provided with a dispensing opening and a flexible flap. An opening is formed in a sheet which will form an outer bag, the position of the opening formed in the sheet for the outer bag and the position of the flap of the inner bag coinciding while the inner container and second contents are stacked. The stacked inner container and the second contents are then wrapped by the sheet for the outer bag and the outer bag is formed.

According to the method for producing a dispenser-container disclosed in Japanese Patent Application Laid-open No. Sho. 61-203305, a process is necessary in which the first contents are contained in the inner container which is provided with an opening and a flexible flap for releasably covering the opening. After this process, it is necessary for the inner container, which hermetically contains the first contents and the second contents, to be wrapped by a sheet for forming the outer bag. Thus, the manufacturing process may be lengthy and productivity is not high.

Further, according to the method, the position of the opening of the sheet for the outer bag and the position of the flap of the inner bag have to coincide with each other while the inner bag and the second contents are stacked. The adjustment upon the manufacturing operation is relatively complicated. Further, since the inner bag itself constitutes a perfect resealable dispenser-container, the finally obtained dispenser-container containing two kinds of contents may be bulky, because of the longitudinal seal when the inner bag is of a pillow type, or because of the sealed peripheries when the inner bag is a four-sided seal pack.

3. Objects of the Invention

The present invention was achieved taking into consideration the above-described problems inherent to the prior art and characteristics required for a dispenser-container for containing wet contents and dry contents.

An object of the present invention is to provide a dispenser-container containing wet and dry contents, by which the above-described problems inherent in the prior art can be obviated.

Another object of the present invention is to provide a dispenser-container containing wet and dry contents, which is inexpensive, compact and easy to handle for portable use.

Still another object of the present invention is to provide a dispenser-container containing wet and dry contents, which is simple in construction and compact and which can be manufactured easily at a low cost.

A further object of the present invention is to provide a process for continuously manufacturing such a dispenser-container.

A still further object of the present invention is to provide an apparatus for performing the process for continuously manufacturing a dispenser-container of the present invention.

SUMMARY OF THE INVENTION

According to the present invention, the above-described objects are achieved by a dispenser-container comprising a container body provided with two containing spaces, one of the containing spaces containing contents in a wet condition and the other of the containing spaces containing contents in a dry condition, characterized in that:

the container body is a bag constituted by a first flexible sheet made of a liquid impervious material and a second flexible sheet made of a liquid impervious material;

the first sheet constitutes a bag of a pillow type, longitudinal edges of the first sheet overlapping each other and being at most slightly sealed with each other to such an extent that they can be manually separated, whereby an opening for dispensing the contents in a dry condition is formed;

the second sheet is attached to the first sheet along the entire peripheries thereof and is located at either the outside or the inside of the bag of a pillow type:

either the first sheet or the second sheet has either an opening or a weakened line for forming the opening, to permit dispensing of the contents in a wet condition therethrough at a position on the surface of the container body opposite to the overlapping longitudinal edges of the first sheet, the opening or line having a flexible flap for resealably covering the opening for dispensing the contents in a wet condition; and the contents in a wet condition are contained in one of the containing spaces formed between the first sheet and the second sheet which is provided with the resealable flap.

It is preferred that the longitudinal edges of the containing space for the tissues in a dry condition be slightly sealed with each other to such an extent that they can be manually separated. Because of this construction, a user is assured by manually separating the longitudinal edges that nobody has previously taken the contents out of the containing space.

However, the longitudinal edges of the first sheet overlapping each other may not be sealed at all with each other.

In place of the above-described arrangement of the opening which is formed by leaving the longitudinal edges of the first sheet unsealed for dispensing the contents in a dry condition, in the dispenser-container according to the present invention the overlapping longitudinal edges of the first sheet may be sealed, and a weakened line such as a perforated line may be formed on the surface of the first sheet, where the overlapping seal is formed, so as to form a tearable opening for dispensing the contents in a dry condition.

The process for manufacturing a dispenser-container provided with two containing spaces according to the present invention is characterized by:

feeding a liquid impervious continuous sheet having weakened lines for forming openings at respective predetermined locations, and having respective flexible flaps for resealably covering the openings after they are formed;

feeding a second liquid impervious continuous sheet in such a manner that it overlies the sheet having the flexible flaps;

supplying contents in a wet condition between the sheets before they completely overlie each other;

supplying contents in a dry condition in such manner that they overlie the contents in a wet condition, sandwiching the aforementioned second sheet therebetween;

attaching both longitudinal edges of one of the sheets to the other sheet:

wrapping the contents in a dry condition by the aforementioned other sheet along the longitudinal direction;

transversely sealing both the sheets; and transversely cutting the sheets.

More specifically, the first process for manufacturing a dispenser-container provided with two containing spaces according to the present invention is characterized by:

feeding a first continuous sheet of a liquid impervious material having weakened lines for forming respective openings therein at predetermined locations, and having respective flexible flaps for resealably covering the openings when formed therein;

disposing contents in a wet condition at positions corresponding to the weakened lines to be the openings on the surface of the first sheet which is opposite to that provided with the flaps;

feeding a second continuous sheet of a liquid impervious material over the contents in a wet condition;

attaching both longitudinal edges of the second sheet to the first sheet;

disposing contents in a dry condition at positions corresponding to the contents in a wet condition and sandwiching the second sheet therebetween;

wrapping the contents in a wet condition, the second sheet and the contents in a dry condition by the first sheet and so as to overlap the longitudinal edges of the first sheet:

transversely sealing the transverse openings of the first and second sheets: and transversely cutting the first and second sheets.

In a second process for manufacturing a dispenser-container provided with two containing spaces according to the present invention, the first sheet is overlaid on the contents in a wet condition after the contents in a wet condition are disposed on the second sheet. This is done instead of overlaying the second sheet on the contents in a wet condition after the contents in a wet condition are disposed on the first sheet as in the first process. According to this second process, the contents in a dry condition may be supplied from beneath and may be wrapped by the first sheet from above.

According to the first and second processes described above, a dispenser-container is obtained wherein the first sheet which has a flap attached thereto constitutes a bag of a pillow type, and the second sheet is inserted into the inside of the pillow type bag formed by the first sheet to serve as a partition.

The third process for manufacturing a dispenser-container provided with two containing spaces according to the present invention is characterized by:

feeding a continuous sheet of a liquid impervious material having weakened lines for forming respective openings therein at predetermined locations, and providing respective flexible flaps for resealably covering the openings disposed thereon;

disposing contents in a wet condition at positions corresponding to the weakened lines to be the openings onto a surface of the continuous sheet opposite to that provided with the flaps;

overlaying a second continuous sheet onto the contents;

attaching both longitudinal edges of the first sheet to the second sheet;

disposing contents in a dry condition at positions corresponding to the contents in a wet condition and sandwiching the second sheet therebetween;

wrapping the contents in a dry condition by the second sheet and overlapping the longitudinal edges of the second sheet:

transversely sealing the transverse openings of the first and second sheets; and transversely cutting the first and second sheets.

In the fourth process for manufacturing a dispenser-container provided with two containing spaces according to the present invention, the first sheet is overlaid on the contents in a wet condition after the contents in a wet condition are disposed on the second sheet. This is done instead of overlaying the second sheet on the contents in a wet condition after the contents in a wet condition are disposed on the first sheet in the third process. According to this process, the contents in a dry condition may be supplied from beneath and may be wrapped by the second sheet from above.

According to the above-described third and fourth processes, a dispenser-container is obtained wherein the second sheet is formed into a bag of a pillow type, and the first sheet which has an opening and a flap attached thereto is attached to the outside of the pillow type bag formed by the second sheet.

Further processes are characterized in that a straight weakened line is first formed near one of the longitudinal edges of the sheet which is formed into a bag of a pillow type in the above-described various processes, and the contents in a dry condition are wrapped by the aforementioned sheet and so as to overlap the longitudinal edges of the aforementioned sheet, and then both the longitudinal edges are sealed. According to these processes, the weakened line such as a perforated line extending in a longitudinal direction in the obtained dispenser-container, serves as an opening for dispensing contents in a dry condition.

An apparatus for manufacturing a dispenser-container provided with two containing spaces according to the present invention is characterized by:

means for feeding a first continuous sheet of a liquid impervious material;

means for feeding a second continuous sheet of a liquid impervious material;

the first sheet having weakened lines for forming respective openings at predetermined locations, and having respective flexible flaps for resealably covering the openings, and the second sheet not being provided with flaps;

means for supplying contents in a wet condition between the first sheet and the second sheet:

means for supplying contents in a dry condition in such manner that they overlie the contents in a wet condition and sandwich the second sheet therebetween;

means for attaching both longitudinal edges of one of the sheets to the aforementioned other sheet:

means for guiding the other sheet so as to wrap the contents in a dry condition by the other sheet along the longitudinal direction of the other sheet;

means for transversely sealing the sheets: and means for transversely cutting the sheets.

The apparatus may further comprise means for slightly sealing the longitudinal edges of the sheet wrapping the contents in a dry condition, means for forming a longitudinally extending weakened line near one of longitudinal edges of the sheet wrapping the contents in a dry condition, or means for sealing longitudinal edges of the sheet wrapping the contents in a dry condition.

BRIEF DESCRIPTION OF THE DRAWINGS

The present invention will now be explained in detail with reference to the accompanying drawings, wherein.

PREFERRED EMBODIMENTS

Embodiments will now be explained referring to FIGS. 1 to 3.

Figure 3:
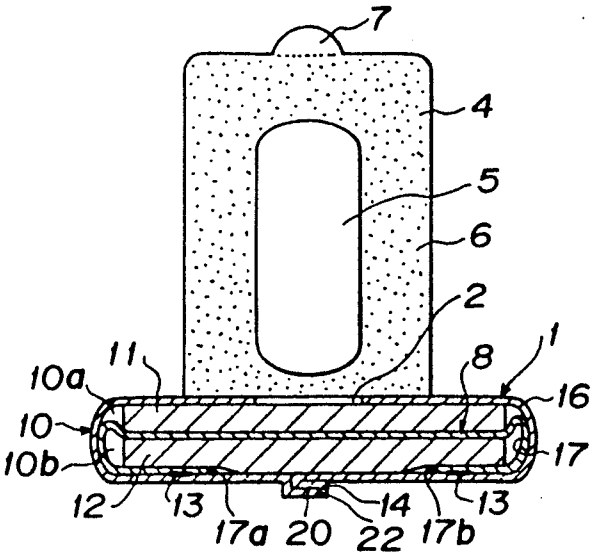
FIG. 3 is a cross sectional view, which is enlarged relative to FIGS. 1 and 2, taken along line III—III in FIG. 1.

In the dispenser-container of the present invention as illustrated, for example in FIG. 3, a filled dispenser-container 10 is provided with two containing spaces 10*a* and 10*b*. One of the containing spaces 10*a* contains contents 11 in a wet condition (wet tissues), and the other of the containing spaces 10*b* contains contents 12 in a dry condition (tissue paper).

The container 10 of the present invention is formed by a partitioned bag constituted by two flexible sheets made of a liquid impervious material, respectively, more preferably of a gas impervious material. One of the two sheets is formed into an outer bag of a pillow type. The other sheet is attached to the first sheet at the inside of the pillow type bag to form a longitudinally extending partition therein.

A first embodiment will now be explained referring to FIGS. 1 to 3.

Figure 1:
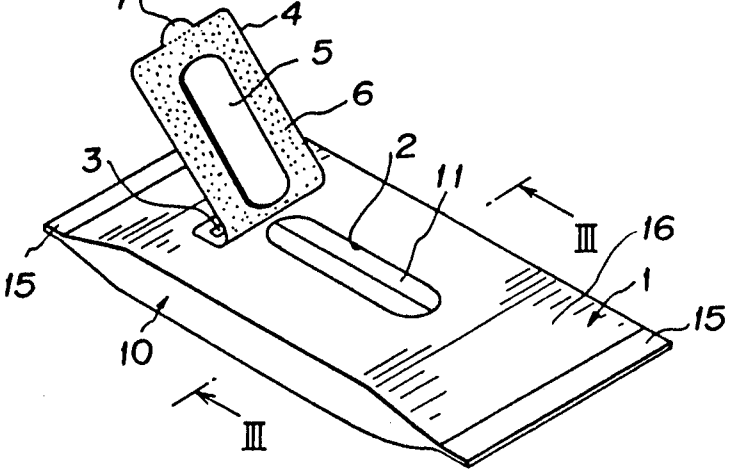
FIG. 1 is a perspective view, seen from one side, of an embodiment of a dispenser-container of the present invention.
Figure 2:
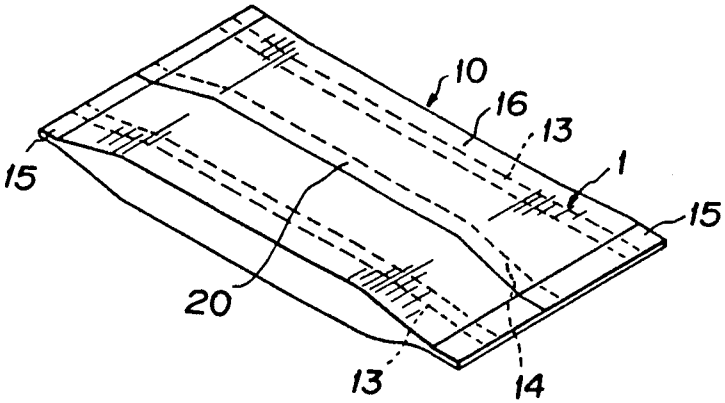
FIG. 2 is a perspective view showing the reverse side of the dispenser-container illustrated in FIG. 1.
Figure 4:
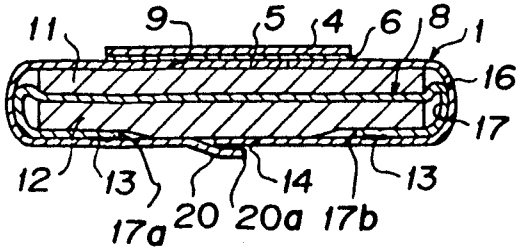
FIG. 4 is a cross sectional view of another embodiment wherein the flap is closed.

In the first embodiment a filled dispenser-container 10 illustrated in FIGS. 1 to 3, a flat pillow type outer bag 1 is formed by a first sheet 16 of a liquid impervious material, and more preferably, a gas impervious material. Both the ends of the bag 1 are sealed as at 15. The bag 1 is provided with a resealable flap 4 on one side thereof. In FIG. 4 the longitudinal edges 14 and 20 on the reverse side of the bag 1 overlap and are not sealed at all with each other so that an overlapped opening 20*a* is formed therebetween. Alternatively, they may be sealed with each other to such an extent that they can be manually separated, as at 22 in FIG. 3.

A second sheet 17 of the same material forms a partition 8 inside the bag 1. The longitudinal edges 17*a*, 17*b* of the second sheet 17 are attached to the inner wall areas of the bag 1 by means of heat sealing, hot melt adhesive or ultra sonic sealing, and the lines of attachment are denoted by reference numerals 13 in FIGS. 3 and 4. Then, both ends of the second sheet 17 are sealed together at 15 with the ends of the first sheet 16. Accordingly, the entire peripheries of the partition 8 are securely attached within the outer bag 1.

The inside of the bag 1 is divided into the two spaces 10*a* and 10*b* by the partition 8. More specifically, in this embodiment, the second sheet 17 serves as the partition 8. Since the partition is arranged inside the bag 1 as described above, the dispenser-container 10 of this embodiment appears to be a single bag 1 in appearance but is provided with two containing spaces 1*a* and 10*b*, where two different contents 11 and 12 can be stored.

The bag 1 has on its reverse side, which is provided with the resealable flap 4, an opening 2 to permit dispensing of the contents from one of containing spaces 10*a* therethrough. Alternatively, the opening 2 need not be opened, but may be designed by a weakened line for forming the opening 2, such as a perforated line 9 (FIG. 5), which is to be opened by the user.

The shape of the dispensing opening 2 or the weakened line 9 for forming the opening 2 may be any suitable shape forming a closed loop, such as a circle, an ellipse, a rectangle or a rhombus or a shape forming an open loop such as a U-shape. The flap 4 substantially covers the opening 2 or the weakened line.

A surface of the flap 4 has a layer of pressure sensitive adhesive 6 applied to substantially its entire inside surface which contacts the outer surface of the bag 1.

The flap 4 may be only adhered to the bag 1. However, it is preferred that the flap 4 be secured to the bag 1 so that it will not be removed from the bag 1 when it is opened. In order to achieve this purpose, there are many ways. Some examples will now be described. One end of the flap 4 may be securely attached to the bag 1 by means of heat sealing, ultrasonic sealing or adhesive, as indicated by reference numeral 3 in FIG. 1. The flap 4 may be provided at one end thereof with a pair of slits extending from the longitudinal sides thereof. Or, flap 4 may have one or more slits at the central portion of one end thereof. Alternatively, the weakened line 9 for forming the dispensing opening 2 may be formed in an open loop, e.g., a U-shape.

If a weakened line for forming the dispensing opening 2 is formed, its circumscribed portion 5 of the bag 1 (FIG. 5) is removed from the bag 1 and the opening 2 is formed upon lifting the flap 4 when the dispenser-container 10 is first used. As a result, the removed portion 5 adheres to the adhesive layer 6 on the inside surface of the flap 4. Thus, the removed portion 5 substantially covers the opening 2 when the flap 4 is subsequently closed to seal the opening 2. In this case, the flap 4 is adhered to the bag 1 by means of the pressure sensitive adhesive layer 6 surrounding the closing seal 5, and hermetically seals the opening 2 of the bag 1.

In place of the above-described closing seal 5 which is constituted by a part of the bag 1, the opening 2 may be fully formed in the bag 1, and a piece of another sheet, the size and shape of which are almost the same as or slightly larger than those of the opening 2, may be adhered to the pressure sensitive layer 6 in such a manner that it covers the opening 2 as a closing seal.

Due to the use of such closing seals 5 covering the opening 2, the contents 11 contained in the bag 1 do not directly contact the pressure sensitive adhesive layer 6 when the flap 4 is closed. Thus, the contents 11 are kept clean. The closing seal 5 may be omitted, for example, if the pressure sensitive adhesive layer 6 is formed only at the periphery of the flap 4.

The above-described containing space with the flap, i.e., the containing space 10*a*, which is formed by the obverse surface of the bag 1 with the flap 4 and the partition 8, can be hermetically sealed, and accordingly, this space is suitable for storing contents 11 in a wet condition, i.e., moistured fibrous materials such as wet tissues.

If the other contents 12 are in a dry condition, the container space is not required to be gas impervious, and accordingly, a flap may be omitted. Thus, in the embodiment of FIGS. 1–3 the other containing space 10*b* is intended to mainly store contents 12 in a dry condition and is not provided with a hermetically sealing flap.

On the reverse side of the bag (see FIGS. 2 and 3), an opening between the overlapping bag edges 14 and 20 for dispensing the contents 12 contained in the other containing space 10*b* is therefore formed without flaps. The opening may be formed as follows.

Longitudinal edges 14 and 20 of the first sheet 16 which forms the bag 1, overlap each other on the surface opposite to that provided with the flap 4, as, for example, illustrated in FIG. 3. In this embodiment, the inside surfaces of the longitudinal edges face toward each other. The longitudinal edges are slightly sealed to each other by means of weak heat sealing or weak adhesive as at 22 to join the edges 14 and 20, but only to such an extent that they can be manually separated. Upon use, the longitudinal edges 14 and 20 are manually separated by breaking the seal 22 so that an opening therebetween for dispensing the contents in a dry condition is formed.

Alternatively, the longitudinal edges 14 and 20 which overlap each other may not be sealed at all, so that an opening 20*a* is fully formed, as in the further embodiment illustrated in FIG. 4. This is, the longitudinal edge 20 of the bag 1 is laid over the other longitudinal edge 14 of the bag 1, and the longitudinal edges are kept unsealed so that an opening 20*a* is formed between the longitudinal edges.

When the longitudinal edges are slightly sealed with each other as at 22 to such an extent that they can be manually separated, the longitudinal edges 14 and 20 can be manually separated by a user upon use, and accordingly, the user is assured that nobody has taken the contents out of the containing space before the user.

The material of the first sheet 16 constituting the liquid impervious bag 1 may be a film made of synthetic resin such as polyethylene, polypropylene, polyamide, polyester, and polyvinyl chloride, and the film may be a single layer or a laminated layer. The film may be a laminated layer of the above-mentioned film and an aluminum sheet taking into consideration the contents.

It is preferred that the material of the first sheet 16 be so selected that the first sheet 16 can be heat sealed. Alternatively, adhesive which has a hot melt property and which has a melting point lower than that of the first sheet 16 may be applied to at least the longitudinal edges which form the bag 1.

The material of the second sheet 17 which provides the partition 8 is liquid impervious, and preferably gas impervious. The material of the second sheet 17 may be a film made of synthetic resin such as polyethylene, polypropylene, polyamide, polyester, and polyvinyl chloride, and the film may be a single layer or a laminated layer. The film may be a laminated layer of the above-mentioned film and an aluminum sheet.

It is preferred that material of the second sheet 17 be so selected that the second sheet can be heat sealed to the inside of the bag 1. Alternatively, adhesive which has a hot melt property and which has a melting point lower than that of the first sheet 16 may be applied to at least the longitudinal edges 17*a*, 17*b* of the second sheet 17.

Since the second sheet 17 is used as the partition 8 in the embodiments illustrated in FIGS. 1 to 4, it is preferred that the thickness of the second sheet 17 be thinner than that of the first sheet 16 and that the second sheet be more flexible than the first sheet 16.

The material of the flap 4 may be similar to that exemplified for the first sheet 16.

With regard to the shape and the size of the flap 4, the area of the flap 4 is larger than that of the opening 2, and the shape is preferably a circle, an ellipse, a rectangle or a rhombus so as to be aesthetic.

It is preferred that the pressure sensitive adhesive layer 6 applied to the inside surface of the flap 4 be acrylic, rubber, polyester, polyolefin or resin adhesive. The application of the adhesive may be done by any suitable method, such as a roll coat, knife coat, spray coat and so on.

If the flap is a transparent sheet, the conditions of the contents and of the opening 2 can be seen from the outside.

Further, the flap 4 is provided with a grip 7 formed by a bulged portion of the flap material at the end opposite to the attached end 3 of the flap 4, which grip 7 is used by the user to open the flap 4. It is preferred that the pressure sensitive adhesive layer 6 not be applied to this grip 7, as illustrated in FIGS. 1 and 3.

The secure attachment of flap 4 to the bag 1 can be done by any suitable method, such as heat seal, ultrasonic seal, high frequency seal, seal by adhesive, depending upon the material of the bag 1. Alternatively, the flap 4 may be provided at one end thereof with a pair of slits extending from the longitudinal sides thereof, or by one or more slits at the central portion at one end thereof so that removal of the flap 4 beyond the slits is prevented.

A process and apparatus for manufacturing the embodiment of the dispenser-container 10 illustrated in FIGS. 1 to 3 will now be described done with reference to FIG. 5.

A continuous web or sheet, i.e., the first sheet 16, to be formed into the bag 1 is fed from a roll 16A in a suitable feeding step 31, such as by a feed roller 31A.

Then, a weakened line, such as a perforated line 9, for forming opening 2 and the closing seal 5 of a suitable shape is formed in a perforating step 32 by a punching machine 32A.

Separately, flaps 4, having a pressure sensitive adhesive layer 6, such as acrylic ester adhesive or rubber adhesive, coated on one side thereof over an area at least larger than the perforations 9, are prepared. For example, a continuously feeding paper web 33 having a plurality of flaps 4 adhered thereto is wound on a roll 33A, which is fed in a feeding step 34 by means of a suitable feed device 34A, such as feed roller, to supply the flaps 4.

Each flap 4 is removed from the feeding paper 33 and is adhesively secured to the first sheet 16 in a securing step 35 by means of a known suitable device 35A such as a labelling machine or by manual operation, in such a manner that the side of the flap 4 with the pressure sensitive adhesive covers the weakened line 9 on the first sheet 16.

If one end of the flap 4 is securely attached to the first sheet 16 by heat sealing, the heat sealing may be done by an appropriate device, such as a heat sealer (not shown) which is disposed after the previous station. This heat sealing step may be omitted when the attaching of flap 4 is done by a method other than heat sealing, such as by the formation of slits or application of adhesive, or when the flap 4 is only adhered to the first sheet 16.

The thus obtained first sheet 16 provided with the weakened lines 9 and the flaps 4 may be directly and continuously transferred in the direction of the arrow in a feeding step 30 to the succeeding station by means of an appropriate device, such as feed rollers 30A. Alternatively, it may be first wound on a bobbin to form a roll (not shown), from which it may then be fed to the next station by means of a suitable device such as a feed roller. When the first sheet is continuously fed to the next station, it is convenient because a winding station and winding apparatus are unnecessary, although the operations of the previous station and the succeeding station must be synchronized. Contrary to this, when the first sheet is first wound on a roll and is then fed to the next station, it is convenient because the timings for forming the weakened line 9 and for adhering the flaps 4 are not required to be synchronized with the timings in the succeeding station for supplying contents 11 and 12 and for packaging them, and further, the apparatus in the previous station and that in the succeeding station can be separately located, and the individual apparatuses may be compact.

Thereafter, sheet-like fibrous materials (wet tissues) 11 made of, for example, synthetic or natural paper, woven fabrics, non-woven fabrics, cut cotton layers for toilet use, gauze, absorbent cotton, or foam sheet, impregnated with or applied with cosmetics, cleaning liquid, medicine or the like are fed onto the first sheet 16, obtained from the previous station, in a supplying step 51 by means of a supply device 51A. In this case, the sheet-like fibrous materials 11 are disposed on portions of the first sheet 16, where openings 2 will be formed upon tearing of the perforations 9, on the side of the sheet opposite to that which is provided with the flaps 4. In other words, the sheet-like fibrous materials 11 are disposed in such a manner that the flap 4 faces outward in the obtained dispenser-container 10.

The supply device 51A may be any suitable device which has been conventionally used to transfer and supply articles to be packed in packaging apparatuses. For example, the supply device 51A may be a chain conveyor with attachments which horizontally transfer articles at a predetermined distance therebetween and feeds them one by one in synchronization with the feed of the wrapping sheet. The supply device 51A may be a material handling device which grips and takes up the uppermost or lowermost article one by one from the articles to be packed which are vertically stacked. The supply device 51A may be a combination of such a conveyor for horizontally transferring articles to be packed and a material handling device which grips and takes up the articles one by one.

The second web or sheet 17 which forms the partitions 8 is withdrawn from roll 17A in a feeding step 36 by an appropriate feed device such as a feed roller 36A and is laid onto the sheet-like fibrous materials 11 which are in a wet condition. Then, the longitudinal edges **17*a*, 17*b* of the second sheet 17 are securely attached to the first sheet 16 in a longitudinal direction, i.e., heat sealed in this embodiment in a securing step 37. The securely attached portions are denoted by reference numerals 13. These attachments can be effected by any suitable means, such as heat sealing by means of side sealers 37A**, by adhering as by means of an adhesive, preferably, hot melt adhesive, or by ultrasonic sealing.

Sheet-like fibrous materials in a dry condition 12, i.e., tissue paper, are supplied in a supplying step 52 by means of the supply device 52A onto the second sheet 17 which covers the sheet-like fibrous materials 11 in a wet condition, in such a manner that the sheet-like fibrous materials 11 and 12 sandwich the second sheet 17 therebetween. Similar to the above-described supply device 51A, the supply device 52A may be conventionally known apparatus and may have a construction similar to that of the supply device 51A.

In the foregoing explanation, after the longitudinal edges **17*a*, 17*b* of the second sheet 17 are securely fixed to the first sheet 16, the dry sheet-like fibrous materials 12 are disposed onto the second sheet 17. The sequence may be reversed, i.e., after the sheet-like fibrous materials 12 in a dry condition are disposed onto the second sheet 17, the longitudinal edges 17***a*, 17*b* of the second sheet 17 may be securely attached to the first sheet 16.

Thereafter, the first sheet 16 is moved through a forming step 38 in which it is guided by a former 38A to wrap the wet sheet-like fibrous materials 11, the second sheet 17 and the dry sheet-like fibrous materials 12 in the first sheet 16, the longitudinal edges 14 and 20 of the first sheet 16 being overlapped on each other.

The longitudinal edges 14 and 20 of the first sheet 16, which overlap each other, are slightly heat sealed to each other in a sealing step 39 by means of a center heat sealer 39A, the sealing being only to an extent such that the edges can be manually separated later. The heat sealed portion is denoted by reference numeral 22 in FIG. 3. The longitudinal edges 14 and 20 of the first sheet 16 may not be sealed at all, though they overlap each other, as at 20*a* in FIG. 4.

The transverse end openings between the first sheet 16 and the second sheet 17, which will constitute the bag 1, are securely sealed together at portions ahead and behind the stacked contents 11 and 12 in a sealing step 40 by means of a conventionally known sealing device 40A, such as a heat sealer or an ultrasonic sealer. The heat sealed portions are denoted by reference numeral 15.

The transversely sealed portions 15 are cut in a cutting step 41 by a cutting device 41A into individual bags which form the dispenser-container 10, of the present invention. In FIG. 5 the filled dispenser-container 10 is illustrated as being in such a condition that the wet sheet-like fibrous materials 11 are located at an upper position and the flap 4 can be seen.

Various embodiments of process and apparatus for manufacturing the embodiments of the dispenser-container of the present invention, which are different from the above-described embodiment will now be explained. In these embodiments, the articles, parts and devices which are the same as those illustrated in FIGS. 1 to 5 are denoted by the same reference numerals, and their further detailed explanation is omitted.

Figure 6:
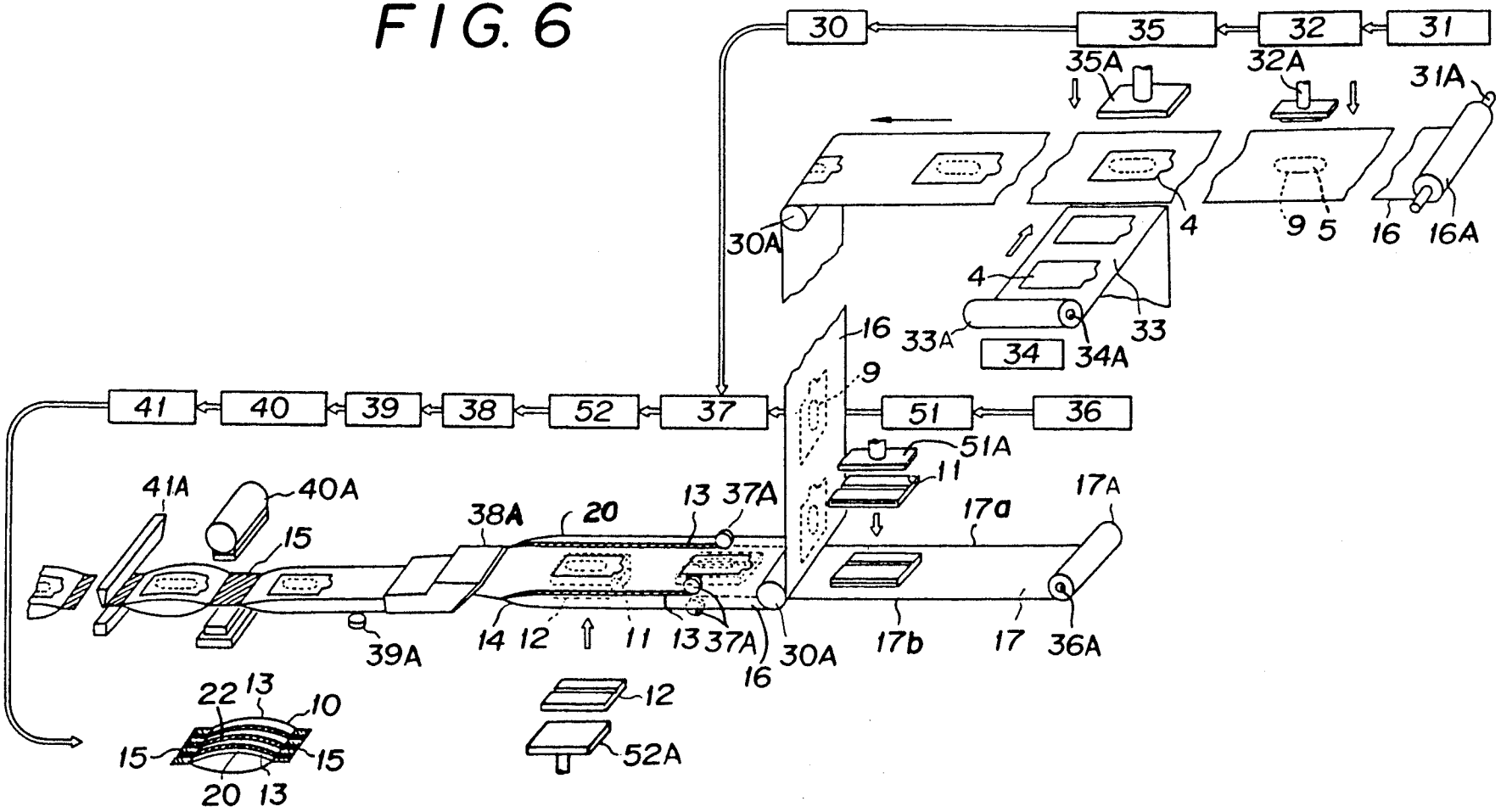
FIG. 6 is a flow diagram showing another process and apparatus for manufacturing the embodiment of the dispenser-container illustrated in FIGS. 1 to 3.

FIG. 6 is a flow diagram showing another process and apparatus for manufacturing the embodiment of the dispenser-container 10 illustrated in FIGS. 1 to 3, or that illustrated in FIG. 4.

Figure 5:
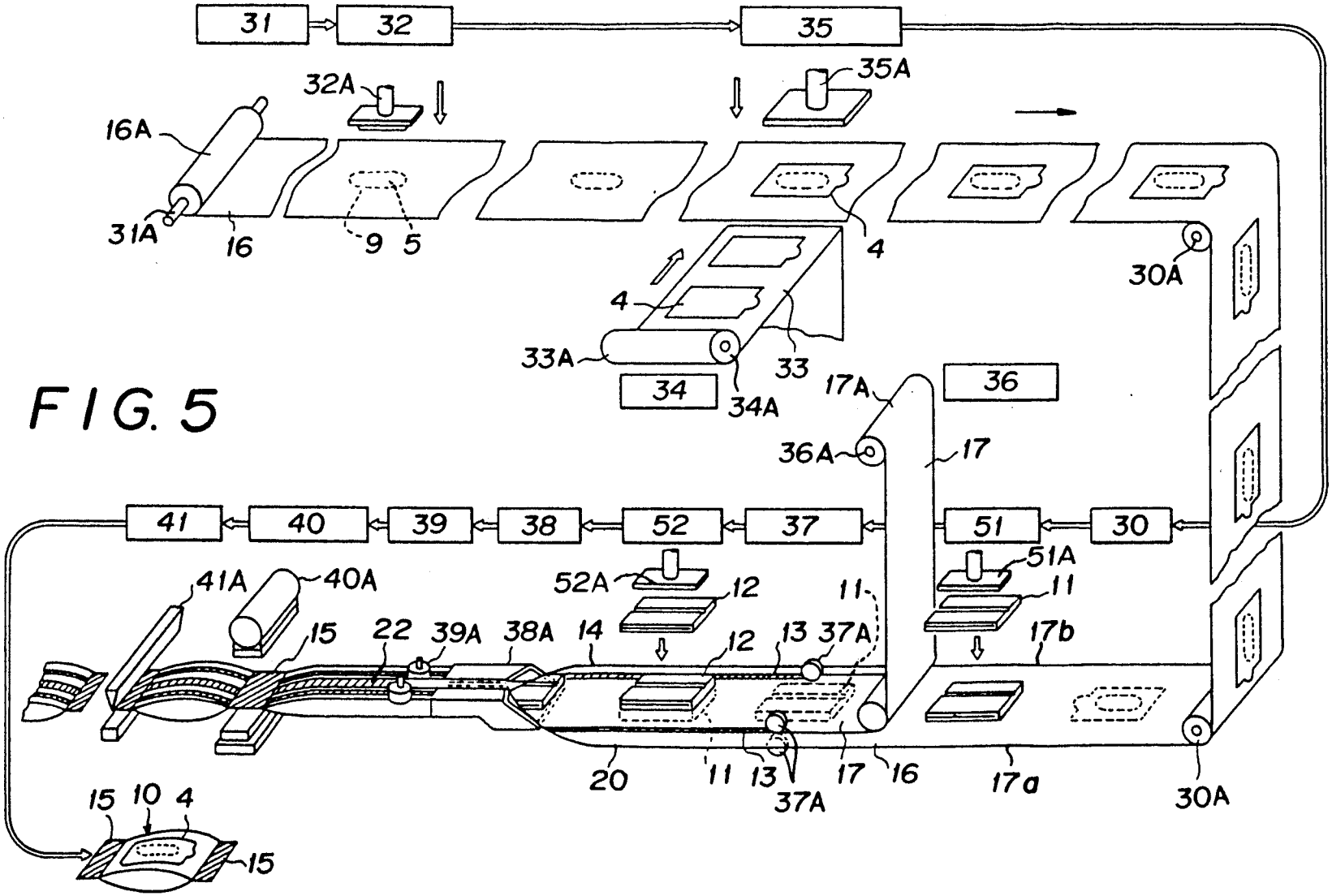
FIG. 5 is a flow diagram showing a process and apparatus for manufacturing the embodiment of the dispenser-container illustrated in FIGS. 1 to 3.

In the process and the apparatus illustrated in FIG. 6, the process and the apparatus before the formation of weakened lines 9 for forming closing seal 5 in the first sheet 16, and the adhering of the flaps 4 covering the lines 9 are similar to those illustrated in FIG. 5. Thus, the first sheet 16 provided with weakened lines 9 and the flaps 4 is prepared and is fed to the next station in a feeding step 30 by means of the feed rolls 30A.

The process illustrated in FIG. 6 is different from that illustrated in FIG. 5 in the following respects.

Although the wet sheet-like fibrous materials were deposted onto the first sheet 16 in the embodiment illustrated in FIG. 5, the wet sheet-like fibrous materials 11 are deposited onto the second sheet 17 in the process illustrated in FIG. 6, and the first sheet 16 is laid onto the wet sheet-like fibrous materials 11. In this instance, the first sheet 16 is laid onto the wet sheet-like fibrous materials 11 in such manner that the weakened lines 9 in the first sheet 16 correspond with the wet sheet-like fibrous materials 11 and the side with the flaps 4 faces outside. Then, after the longitudinal edges of the second sheet 17 are securely attached to the first sheet 16 in a longitudinal direction (the securely attached portion is denoted by reference numeral 13), sheet-like fibrous materials in a dry condition 12 are supplied from below to positions corresponding to the wet sheet-like fibrous materials in such a manner that the sheet-like fibrous materials 11 and 12 sandwich the second sheet 17 therebetween.

Thereafter, the first sheet 16 is guided by a former 38A so that the first sheet 16 wraps the wet sheet-like fibrous materials 11, the second sheet 17 and the dry sheet-like fibrous materials 12 from above, and the longitudinal edges of the first sheet 16 are overlapped on each other. The overlapping longitudinal edges cannot be seen because the are on the rear side.

The filled dispenser-container 10 of the present invention is obtained in accordance with a process similar to that explained with reference to FIG. 5. More specifically, the longitudinal edges 14 and 20 of the first sheet 16, which overlap each other, are slightly heat sealed with each other by means of a center heat sealer 39A to such an extent that they can be manually separated later, the heat sealed portion being denoted by reference numeral 22, or are not sealed at all though they overlap each other as at 20*a*. Then, the transverse openings of the first sheet 16 are securely sealed together at portions ahead and behind the stacked contents 11 and 12, the heat sealed portions being denoted by reference numeral 15, by means of a sealing device 40A. Thereafter, the transversely sealed portions 15 are cut by a cutting device 41A into the individual filled dispenser-containers 10.

In FIG. 6, the obtained dispenser-container 10 is illustrated in such a condition that the dry sheet-like fibrous materials 12 are located at an upper position and the opening for dispensing dry sheet-like fibrous materials can be seen. In short, the dispenser-container illustrated in FIG. 6 is seen from the side opposite to that of FIG. 5.

Figure 7:
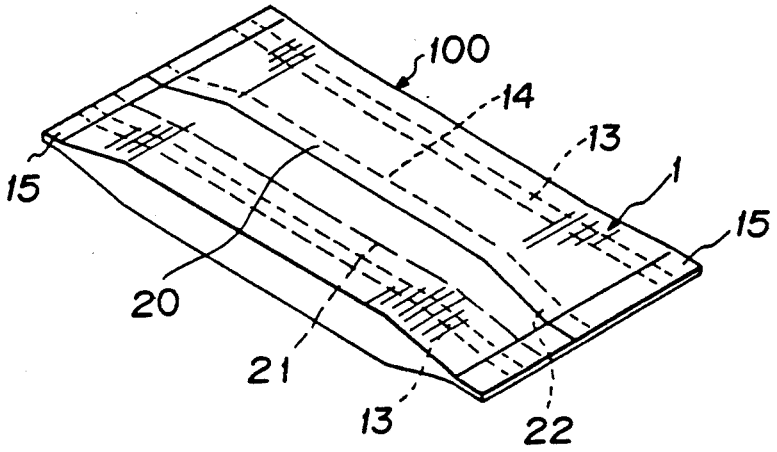
FIG. 7 is a perspective view of a third embodiment of a dispenser-container of the present invention, wherein an opening for dispensing sheet-like materials in a dry condition faces upwardly.
Figure 8:
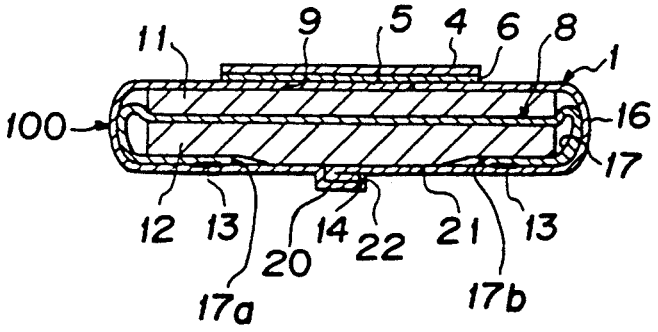
FIG. 8 is a cross sectional view of the third embodiment illustrated in FIG. 7, which view is similar to FIG. 4.

FIG. 7 is a perspective view of another embodiment of a filled dispenser-container 100 of the present invention, wherein a perforated line 21 for forming an opening for dispensing sheet-like fibrous materials 12 in a dry condition faces upward. FIG. 8 is an inverted cross sectional view of the embodiment illustrated in FIG. 7, which view is similar to FIG. 3.

The dispenser-container 100 of this third embodiment differs from that of the first embodiment, i.e., the dispenser-container 10 illustrated in FIGS. 1 to 3.

In this embodiment, as illustrated in FIG. 7, a perforated line 21 for forming an opening to permit dispensing of the dry sheet-like fibrous materials 12 is formed in the first sheet 16 so as to be on a side of the bag 1, which side is not provided with the resealable flap 4. The overlapping longitudinal edges 14 and 20 of the first sheet 16 are sealed. The sealed portion is designated by reference numeral 22. Accordingly, this third embodiment 100 differs from those illustrated in FIGS. 1 to 3 and 4 in that the longitudinal edges 14 and 20 of the first sheet 16 do not serve as an opening for dispensing the dry sheet-like fibrous materials 12. Upon use, the straight weakened line 1 formed in the first sheet 16 is torn to form an opening, which serves to dispense dry sheet-like fibrous materials 12.

The remaining construction of this embodiment is substantially the same as that of the first embodiment.

A process and an apparatus for manufacturing the dispenser-container 100 illustrated in FIGS. 7 and 8 will now be explained.

Figure 9:
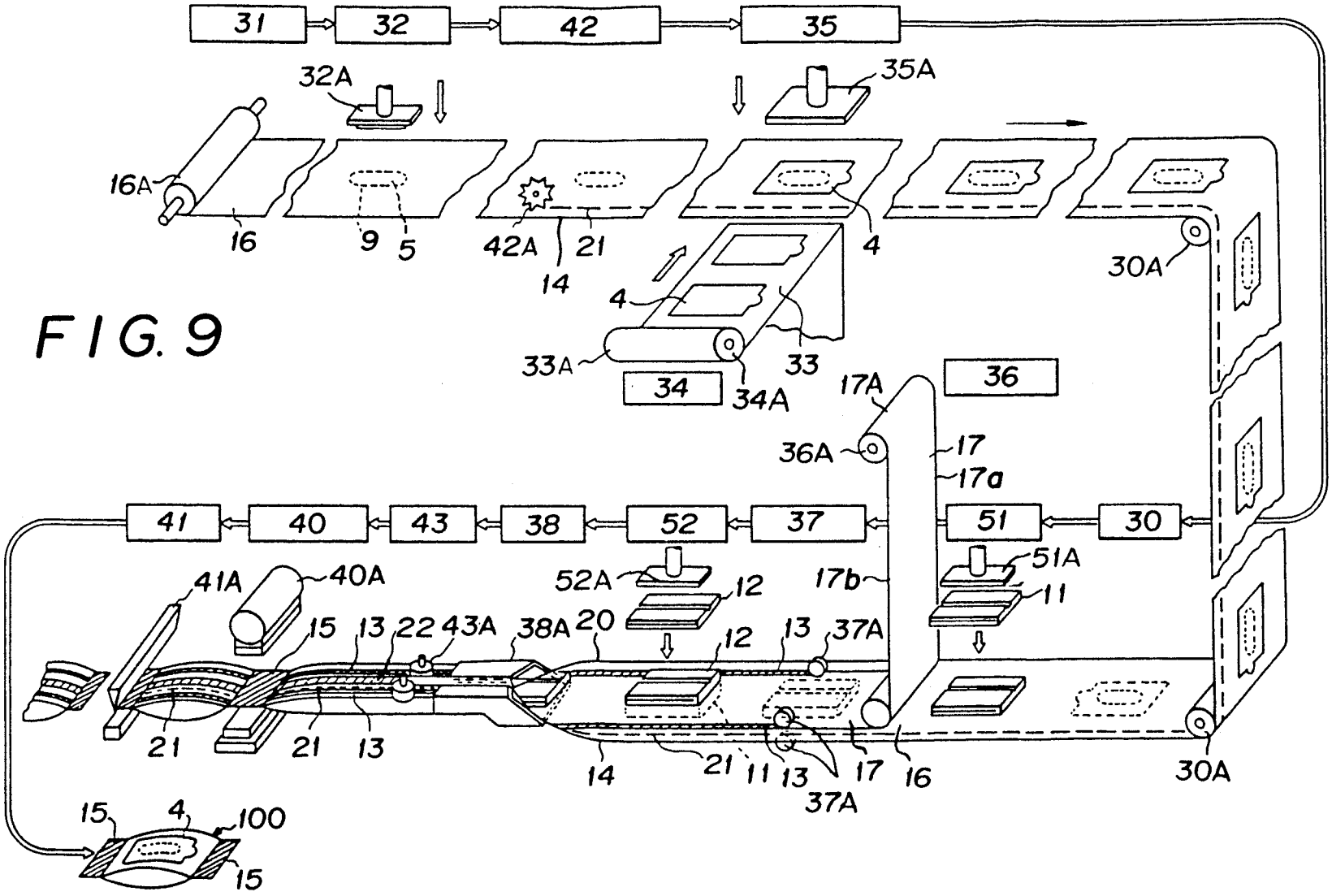
FIG. 9 is a flow diagram showing a process and an apparatus for manufacturing the third embodiment of the dispenser-container illustrated in FIGS. 7 and 8.

FIG. 9 illustrates an embodiment of the manufacturing process and is substantially the same as that illustrated in FIG. 5 except for the following.

A weakened line 21 extending longitudinally is formed near one of the longitudinal edges 14 of the first sheet 16 in a perforating step 42 by means of a perforated line forming device 42A. Although the formation of the perforated line 21 is illustrated as a step 42 to be performed just after the punching process 32 effected by the punching machine 32A in FIG. 9, the location is not limited to the above-described position as long as it is before the wrapping of the sheet-like fibrous materials 11 and 12 by the first sheet 16, i.e., before the former 38A.

Further, after two kinds of sheet-like fibrous materials 11 and 12 are wrapped by the first sheet 16 and the longitudinal edges 14 and 20 of the first sheet 16 are overlapped, the overlapped longitudinal edges of the first sheet 16 are heat sealed in a heat sealing step 43 by the center heat sealer 43A. The sealed portion therebetween is designated by reference numeral 22. Accordingly, different from the embodiment illustrated in FIG. 5, the longitudinal edges of the first sheet 16 do not provide an opening for dispensing the dry sheet-like fibrous materials 12. Instead, the perforated line 21 formed in the first sheet 16 becomes a dispensing opening for the sheet-like fibrous materials 12.

Other steps in this embodiment are similar to those of the embodiment illustrated in FIG. 5.

Figure 10:
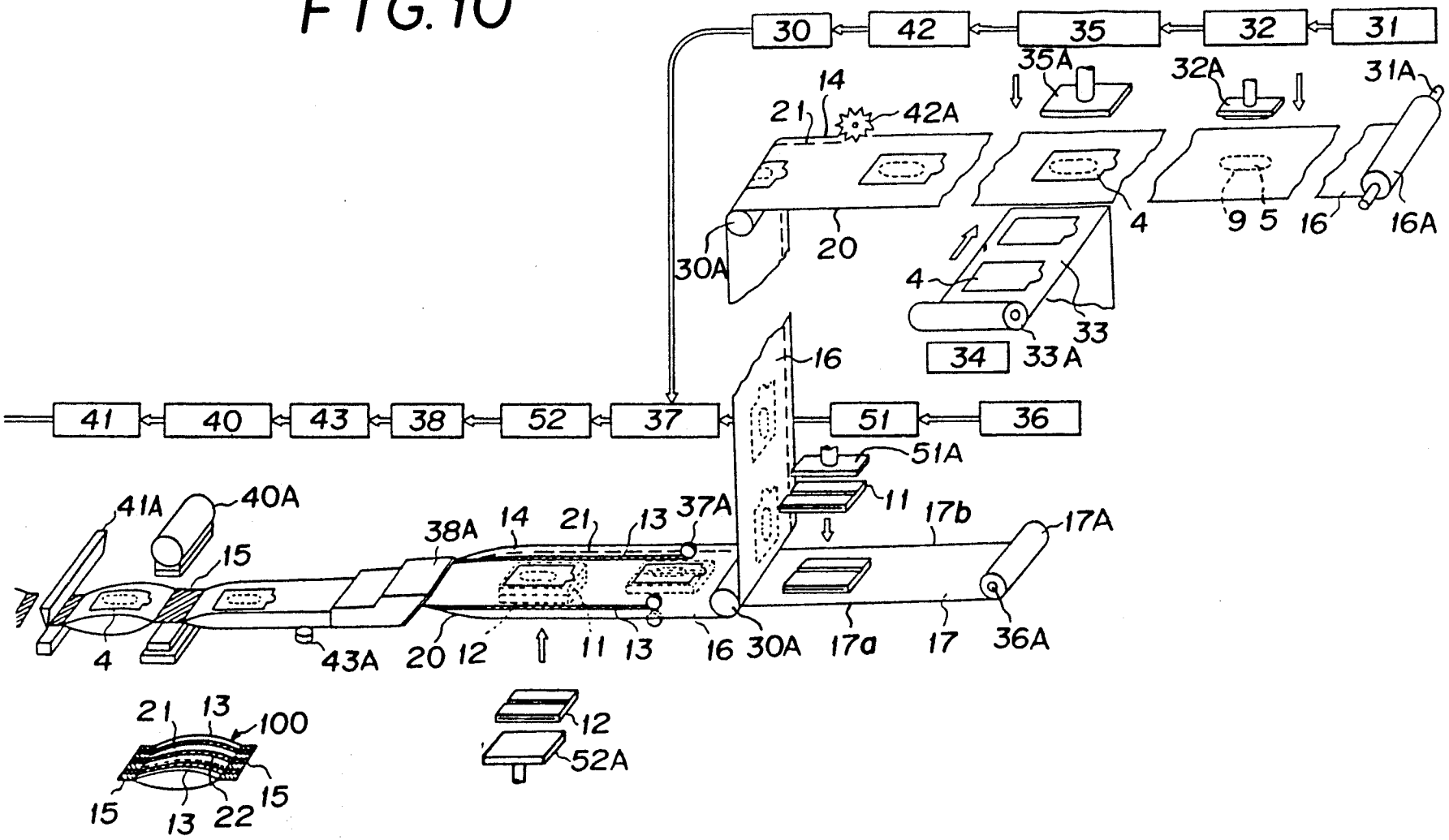
FIG. 10 is a flow diagram showing another process and apparatus for manufacturing the embodiment of the dispenser-container illustrated in FIGS. 7 and 8.

FIG. 10 is a flow diagram showing another process and apparatus for manufacturing the embodiment of the dispenser-container 100 illustrated in FIGS. 7 and 8, and it is generally similar to FIG. 6 but differs from FIG. 6 in the points explained with reference to FIG. 9.

More specifically, this embodiment differs from that illustrated in FIG. 6, in that a weakened line 21 extending longitudinally is formed near one of the longitudinal edges 14 of the first sheet 16 in a perforating step 42 by means of a perforated line forming device 42A; and in that after the two kinds of sheet-like fibrous materials 11 and 12 are wrapped by the first sheet 16 and the longitudinal edges 20 and 14 of the first sheet 16 are overlapped, the overlapped longitudinal edges of the first sheet 16 are heat sealed in a sealing step 43 by the center heat sealer 43A.

Although FIG. 10 illustrates that the formation of the perforated line 21 is done just after the punching step 32, by the punching machine 32A as is that in FIG. 9, the location is not limited to the above-described position as long as it is before the wrapping of the sheet-like fibrous materials 11 and 12 by the first sheet 16.

Other steps in this embodiment are similar to those of the embodiment illustrated in FIG. 6.

Figure 11:
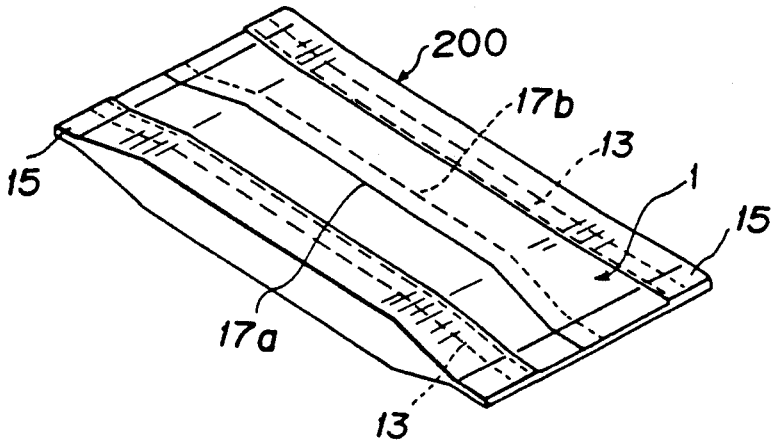
FIG. 11 is a perspective view of a fourth embodiment of a dispenser-container of the present invention, wherein an opening for dispensing sheet-like materials in a dry condition faces upwardly.
Figure 12:
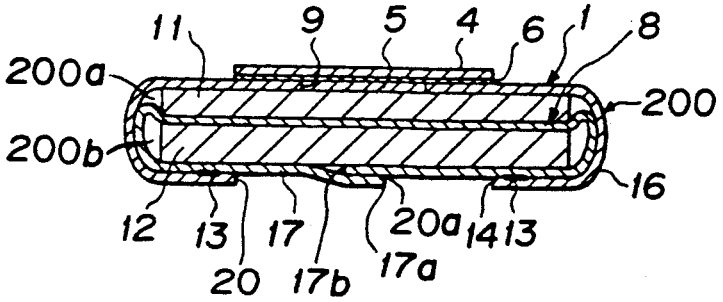
FIG. 12 is a cross sectional view of the fourth embodiment illustrated in FIG. 11, which view is similar to FIG. 4.

FIG. 11 is a perspective view of a still further embodiment of a filled dispenser-container 200 of the present invention, wherein an opening for dispensing sheet-like materials 12 in a dry condition faces upward, and FIG. 12 is an inverted cross sectional view of the embodiment illustrated in FIG. 11, which view is similar to FIG. 3.

The dispenser-container 200 of this fourth embodiment differs from that of the first embodiment, i.e., the dispenser-container 10 illustrated in FIGS. 1 to 3.

In the first embodiment, the second sheet 17 is located entirely inside the pillow type bag 1 formed by the first sheet 16. Contrary to this, in this embodiment illustrated in FIGS. 11 and 12, the width of the first sheet 16 is narrower, and that of the second sheet 17 is made wider. Thus, the longitudinal edges 17*a*, 17*b* of the second sheet 17 overlap to form the seal of the pillow type bag 1.

The longitudinal edges 17*a*, 17*b* of the second sheet 17 are securely attached to the first sheet 16 by means of heat sealing, ultrasonic sealing, hot melt adhesive, etc., and the securely sealed portion is denoted by reference numeral 13. The ends of the second sheet 17 are securely attached at the ends of the first sheet 16 by means of heat sealing, ultrasonic sealing, hot melt adhesive, etc. as at 15.

Accordingly, in the dispenser-container of this embodiment, a containing space 200*a* is formed between the second sheet 17 and the first sheet 16, and at the same time, another containing space 200*b* is formed within the second sheet 17. Thus, the dispenser-container 200 of the fourth embodiment has an appearance similar to a regular pillow type bag and is compact, and is provided with two containing spaces like the first embodiment. The containing space 200*a* formed between the second sheet 17 and the first sheet 16 contains the wet sheet-like fibrous materials 11, and the containing space 200*b* formed by the second sheet 17 contains dry sheet-like fibrous materials 12.

Further, in this fourth embodiment, the perforated line 9 for forming an opening for dispensing the wet sheet-like fibrous materials 11 is formed in the first sheet 16, and the flap 4 for resealably covering the portion surrounded by the perforated line 9 for forming the opening is also adhered to the first sheet 16.

This embodiment is substantially the same as the first embodiment.

Similar to the embodiment illustrated in FIG. 4, an unsealed opening 20*a* for dispensing the dry sheet-like fibrous materials 12 is formed by overlapping the longitudinal edges 17*a*, 17*b* of the second sheet 17, which edges are kept unsealed.

The remaining construction is similar to that of the first embodiment.

A process and an apparatus for manufacturing the dispenser-container 200 illustrated in FIGS. 11 and 12 will now be explained.

Figure 13:
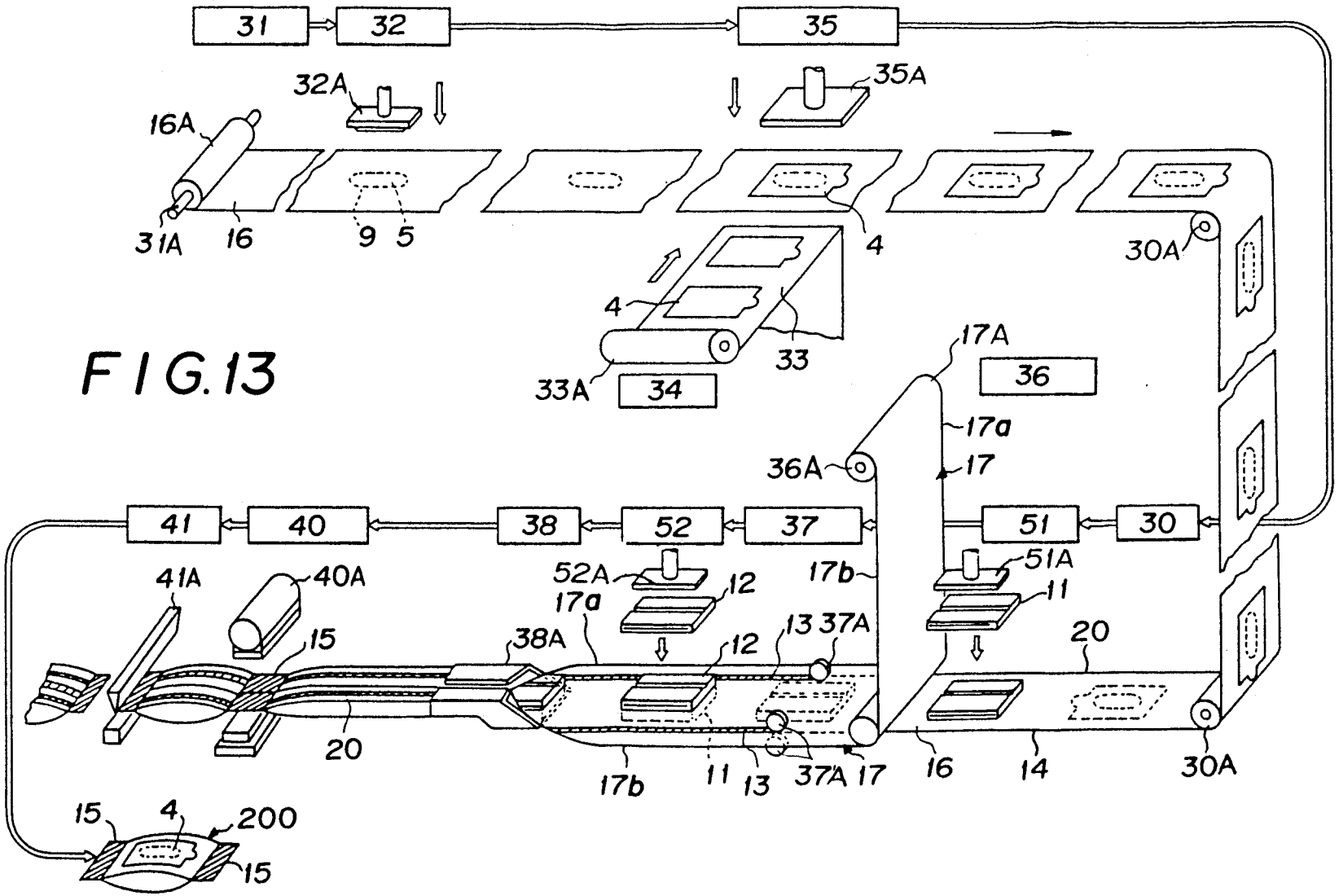
FIG. 13 is a flow diagram showing a process and an apparatus for manufacturing the fourth embodiment of the dispenser-container illustrated in FIGS. 11 and 12.

FIG. 13 is an embodiment of the manufacturing process and is similar to the process and apparatus illustrated in FIG. 5 except for the following.

In the embodiment illustrated in FIG. 5, the first sheet 16 for forming the pillow type bags was provided with the weakened lines 9, i.e., the perforated lines, and the flaps 4. The embodiment of FIG. 13, the same is true, except that the width of the first sheet 16 is made narrower than that of the second sheet 17.

The thus obtained first sheet 16 provided with the weakened lines 9 and the flaps 4 may be directly and continuously transferred to the succeeding station by means of an appropriate feed device 30A, such as a feed roller, or may be first wound on a bobbin to form a roll (not shown), from which the first sheet 16 may be then fed to the next station by means of a suitable device 30A such as a feed roller.

Thereafter, sheet-like fibrous materials (wet tissues) 11 made of, for example, synthetic or natural paper, woven fabrics, non-woven fabrics, cut cotton layers for toilet use, gauze, absorbent cotton, or foam sheet impregnated with or applied with cosmetics or medicine are fed onto the first sheet 16, obtained in the previous station in a supplying step 51 by means of a supply device 51A. In this case, the sheet-like fibrous materials 11 are disposed on portions of the first sheet 16, where openings 2 will be formed, on the side opposite to that provided with the flaps 4. In other words, the sheet-like fibrous materials 11 are disposed in such a manner that the flap 4 faces outward in the obtained dispenser-container.

The second sheet 17, which is wider than the first sheet 16, is withdrawn from roll 17A by an appropriate feed device 36A and is laid on the sheet-like fibrous materials 11 in a wet condition. Then, the longitudinal edges 14 and 20 of the first sheet 16 are securely attached to the second sheet 17, the securely attached portion being denoted by reference numeral 13.

Sheet-like fibrous materials in a dry condition 12, i.e., tissue paper, are supplied in a supplying step 52 by means of the supply device 52A onto the second sheet 17 overlying the sheet-like fibrous materials in a wet condition 11.

Thereafter, the first sheet 16 and the second sheet 17 are folded by a former 38A to wrap the dry sheet-like fibrous materials 12 in the second sheet 17, the longitudinal edges 17*a* and 17*b* of the second sheet 17 being overlapped with each other. The longitudinal edges 17*a* and 17*b* of the second sheet 17 may not be sealed at all though they overlap each other.

The transverse openings of the first sheet 16 and the second sheet 17 are securely sealed together at portions ahead and behind the stacked contents 11 and 12 in a sealing step 40 by means of a conventionally known sealing device 40A, such as a heat sealer or an ultrasonic sealer. The heat sealed portions are denoted by reference numerals 15.

The remaining features are the same as those of the process and apparatus illustrated in FIG. 5.

Figure 14:
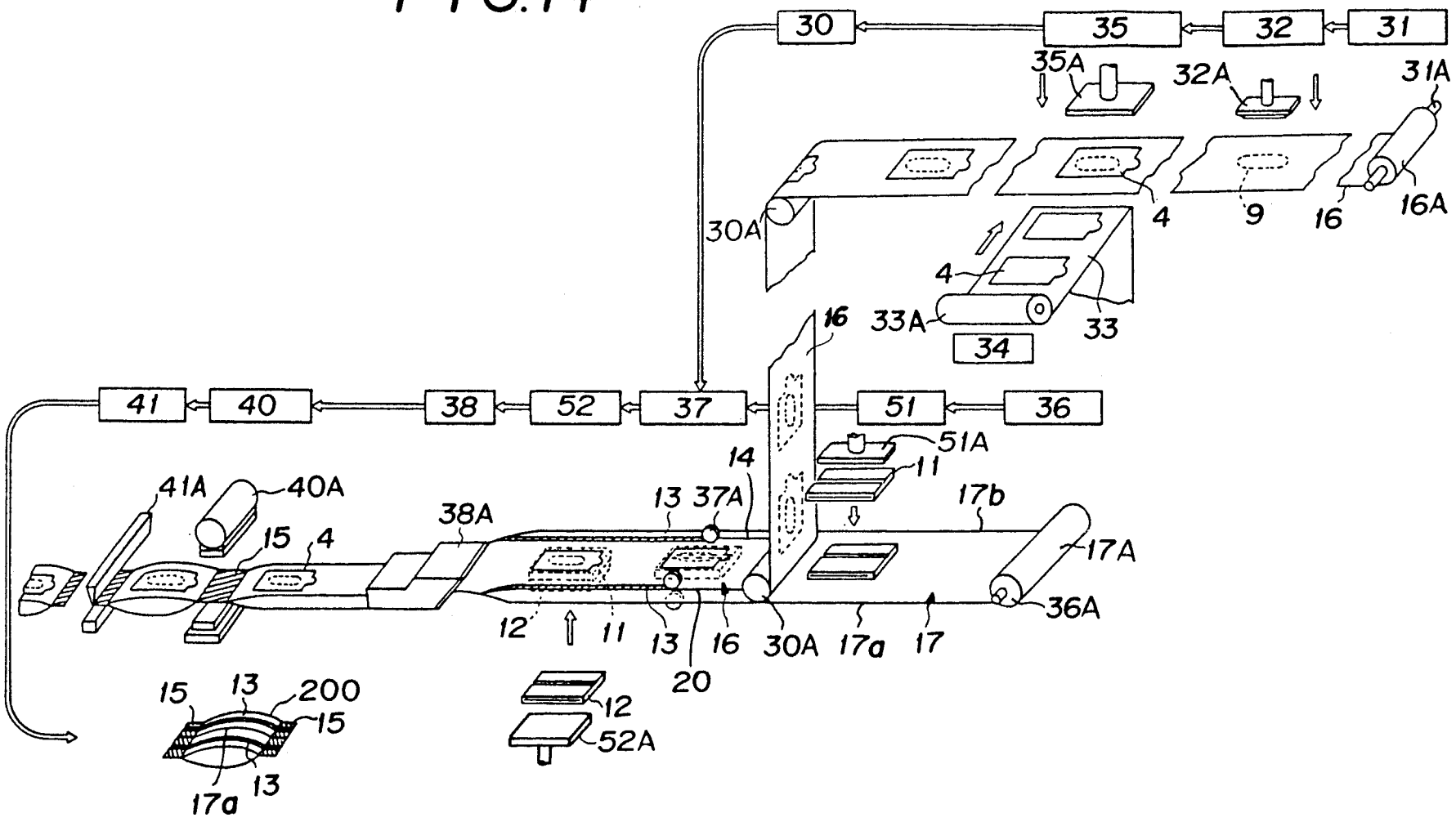
FIG. 14 is a flow diagram showing another process and apparatus for manufacturing the embodiment of the dispenser-container illustrated in FIGS. 11 and 12.

FIG. 14 is a flow diagram showing another process and apparatus for manufacturing the embodiment of the dispenser-container 200 illustrated in FIGS. 11 and 12.

In the process and the apparatus illustrated in FIG. 14, the steps before the formation of the weakened lines 9 for forming the openings 2 in the sheet 16 and attachment of the flaps 4 for covering the perforations 9 are similar to those illustrated in FIG. 13.

The process illustrated in FIG. 14 is different from that illustrated in FIG. 13 in the following points.

Although the wet sheet-like fibrous materials 11 were supplied onto the perforations 9 in the embodiment illustrated in FIG. 13, the wet sheet-like fibrous materials 11 are disposed on the second sheet 17, over which the first sheet 16 is laid in the embodiment illustrated in FIG. 14. In this instance, the first sheet 16 is narrower than the second sheet 17 and is laid on the wet sheet-like fibrous materials 11 in such a manner that the weakened lines 9 of the first sheet 16 correspond to the wet sheet-like fibrous materials 11 and so that the surface provided with the flaps 4 faces outward. Then, the longitudinal edges 14 and 20 of the first sheet 16 are securely attached to the second sheet 17. Thereafter, the dry sheet-like fibrous materials 12 are supplied from beneath in the supplying step 52 to positions corresponding to the wet sheet-like fibrous materials 11. The former 38A assists the second sheet 17 to wrap the dry sheet-like fibrous materials 12 from above and overlap the longitudinal edges 17*a*, 17*b* of the second sheet 17. The overlapping edges cannot be seen in FIG. 14 since they are below the dispenser-container.

Similar steps to those explained with reference to FIG. 13 are carried out, and the dispenser-container 200 of the present invention is obtained. More specifically, the transverse openings of the first and second sheets are securely sealed together at portions ahead and behind the stacked contents 11 and 12 in a sealing step 40 by means of a conventionally known sealing device 40A, such as a heat sealer or an ultrasonic sealer. The transversely sealed portions 15 are cut in a cutting step 41 by a cutting device 41A into individual bags to form the dispenser-containers 200, of the present invention. In FIG. 14, the obtained dispenser-container 200 is illustrated in such a condition that the dry sheet-like fibrous materials 12 are located at an upper position and the opening at the edge 17*a* for dispensing the sheet-like fibrous materials 12 can be seen. In other words, in FIG. 14, this dispenser-container is observed in a direction reversed from that in FIG. 13.

Figure 15:
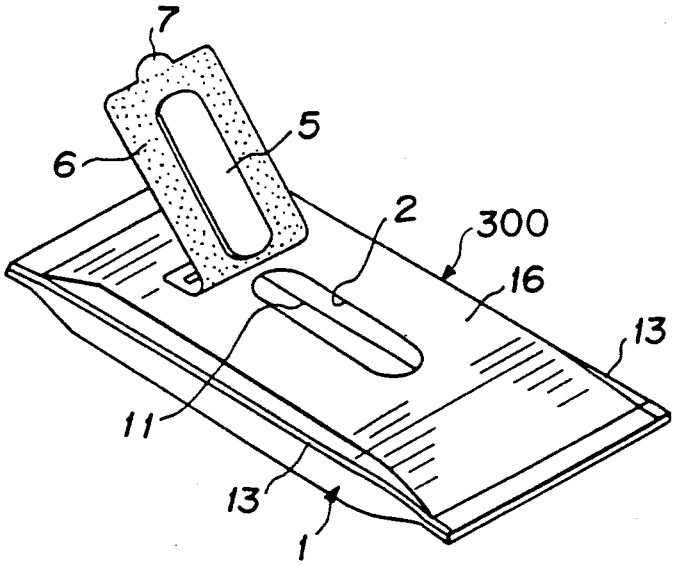
FIG. 15 is a perspective view of a fifth embodiment of a dispenser-container of the present invention, wherein an opening for dispensing sheet-like materials in a wet condition faces upwardly.
Figure 16:
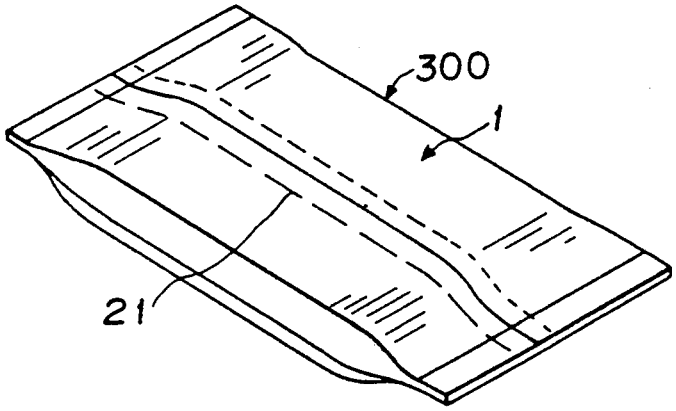
FIG. 16 is a perspective view showing the reverse side of the dispenser-container of the fifth embodiment.
Figure 17:
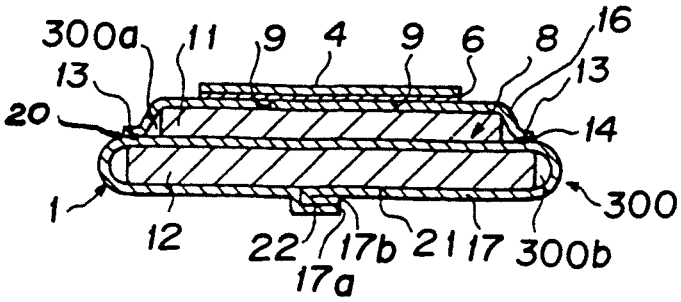
FIG. 17 is a cross sectional view of the embodiment illustrated in FIGS. 15 and 16, which view is similar to FIG. 4.

FIG. 15 is a perspective view of another embodiment of a dispenser-container 300 of the present invention, wherein an opening 2 for dispensing sheet-like materials 11 in a wet condition faces upward, FIG. 16 is a perspective view showing the rear side of the dispenser-container 300 of this embodiment, and FIG. 17 is a cross sectional view of the embodiment illustrated in FIGS. 15 and 16, which view is similar to FIG. 8.

This fifth embodiment is similar to the fourth embodiment illustrated in FIG. 8 in the following points. The first sheet 16 is located outside the pillow type bag 1 formed by the second sheet 17. The entire peripheries of the first sheet 16 are securely attached to the second sheet 17. The containing space 300*a* formed between the first sheet 16 and the second sheet 17 contains the wet sheet-like fibrous materials 11, and the containing space 300*b* formed by the second sheet 17 contains the dry sheet-like fibrous materials 12.

However, this embodiment differs from the fourth embodiment of the dispenser-container in the points set forth below.

The heat seals 13 which securely attach the longitudinal edges 14 and 20 of the first sheet 16 are made on the surface of the second sheet 17 where the opening 20*a* for dispensing the dry sheet-like fibrous materials 12 is formed in the fourth embodiment illustrated in FIGS. 11 and 12. Contrary to this, in the fifth embodiment, as it is obvious from FIG. 17, the heat seals 13 which securely attach the longitudinal edges 14 and 20 of the first sheet 16 to the second sheet 17 are located on the surface opposite to that where the opening for dispensing the dry sheet-like fibrous materials 12 is formed.

Accordingly, should the size of the contained wet sheet-like fibrous materials 11 be the same, the width of the first sheet 16 of the fifth embodiment can be narrower than that in the fourth embodiment.

When the first sheet 16 is disposed outside the second sheet 17 as described with respect to the fourth and fifth embodiments, the width of the first sheet 16 is not limited by the width of the second sheet 17 and can be appropriately set in accordance with the thickness of the contents 11 to be packed. Accordingly, in some cases, the width of the first sheet 16 may be wider than that of the second sheet 17. Contrary to this, when the second sheet 17 is inside the bag formed by the first sheet 16 as described with respect to the first to third embodiments, it is preferred that the width of the second sheet 17 is at most equal to the width of the first sheet 16.

Contrary to the dispenser-container of the fourth embodiment, in the fifth embodiment of the dispenser-container, the perforated line 21, which will form an opening for dispensing the dry sheet-like fibrous materials 12, is formed in the second sheet 17 at a surface of the dispenser-container 300 which is opposite to that provided with the flap 4 (see FIG. 16). The longitudinal edges 17*a* and 17*b* of the second sheet 17 are sealed together. (See FIG. 17, wherein the sealed portion is indicated by reference numeral 22.) Accordingly, contrary to the fourth embodiment illustrated in FIGS. 11 and 12, the longitudinal edges 17*a* and 17*b* of the second sheet 17 do not serve as an opening for dispensing the dry sheet-like fibrous materials 12. Upon use, the perforated line 21 formed in the second sheet is torn to form an opening, where the dry sheet-like fibrous materials 12 are dispensed.

The remaining constructions of the fifth embodiment are similar to those in the first embodiment explained with reference to FIGS. 1 to 3.

Figure 18:
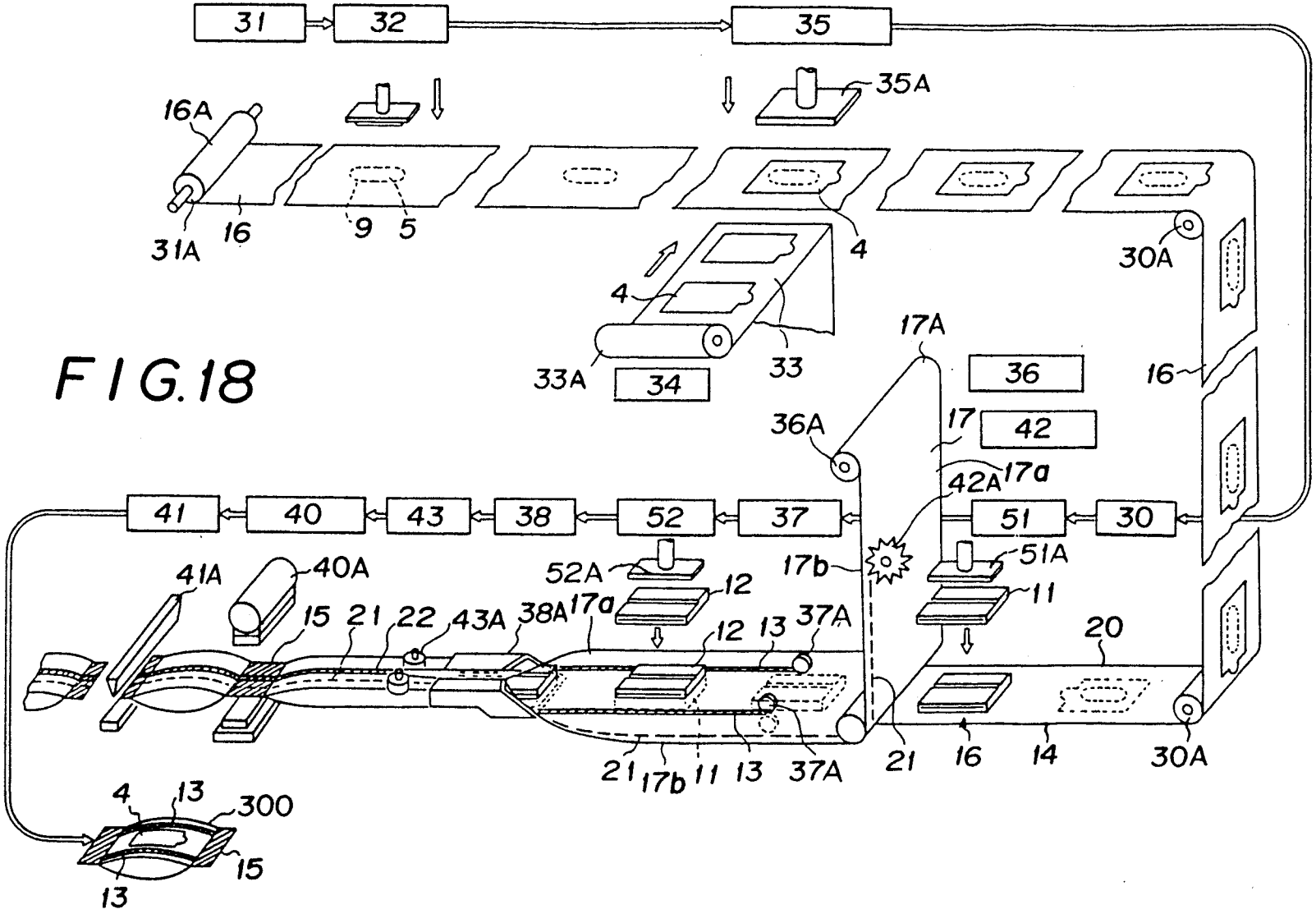
FIG. 18 is a flow diagram showing a process and an apparatus for manufacturing the fifth embodiment of the dispenser-container illustrated in FIGS. 15 to 17.

FIG. 18 illustrates an embodiment of a process and apparatus for manufacturing the fifth embodiment 300 of the dispenser-container, which are similar to the process and the apparatus illustrated in FIG. 13, except for the following points.

A weakened line 21 is formed near one of the longitudinal edges 17*b* of the second sheet 17 in a perforating step 42 by means of a perforated line forming device 42A.

After the dry sheet-like fibrous materials 12 are wrapped by the second sheet 17, the longitudinal edges 17*a* and 17*b* of which are overlapped, the overlapped edges are heat sealed in a center heat sealing step 43 by the center heat sealer 43A, the sealed portion being indicated by reference numeral 22. Accordingly, contrary to the embodiment illustrated in FIGS. 11 and 12, the longitudinal edges 17*a* and 17*b* of the second sheet 17 do not serve as an opening for dispensing the dry sheet-like fibrous materials 12.

The remaining constructions of the fifth embodiment are similar to those in the embodiment explained with reference to FIG. 13.

Figure 19:
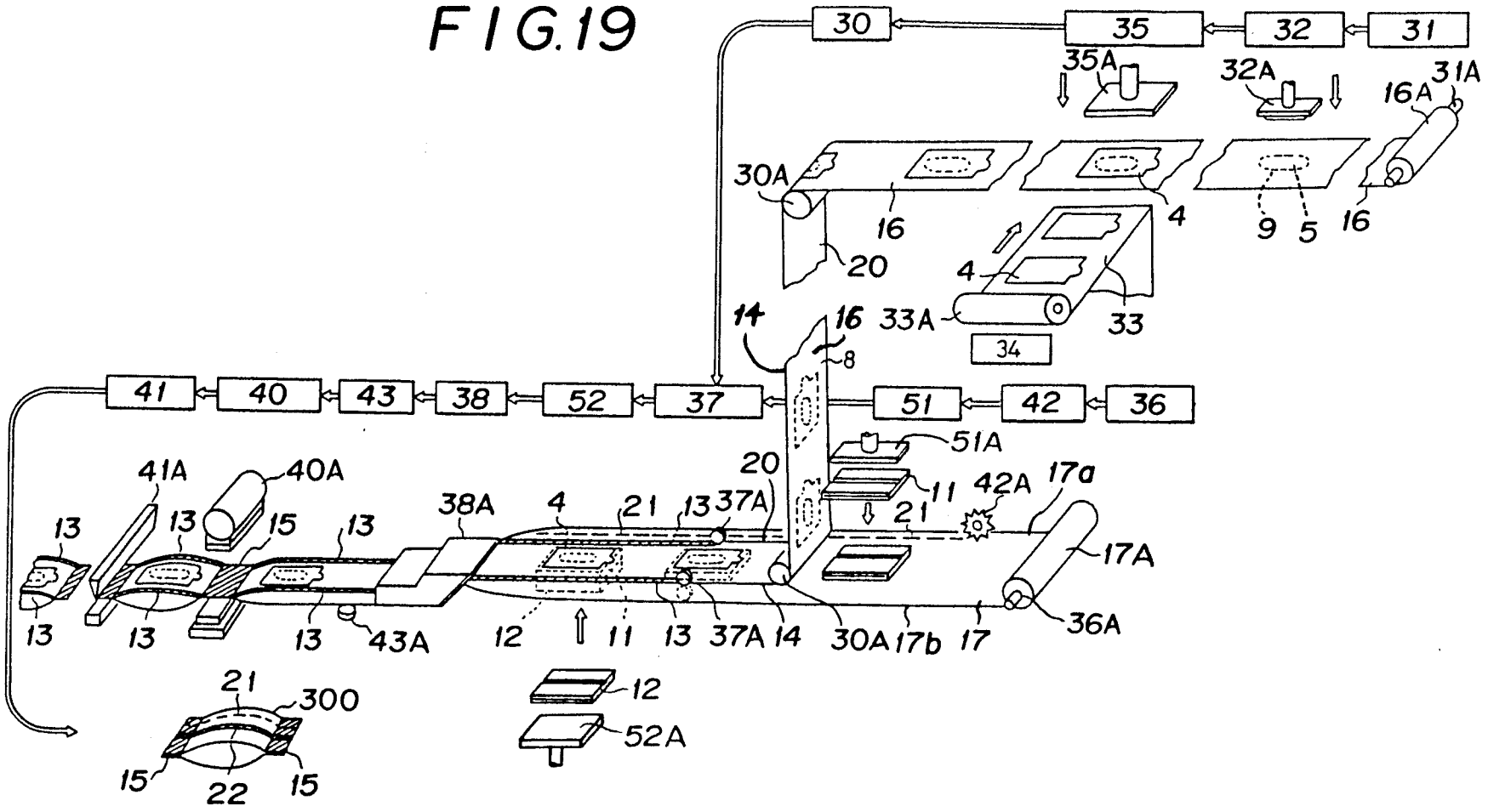
FIG. 19 is a flow diagram showing another process and apparatus for manufacturing the fifth embodiment of the dispenser-container illustrated in FIGS. 15 to 17.

FIG. 19 is a flow diagram showing another process and apparatus for manufacturing the fifth embodiment of the dispenser-container 300. The process and apparatus as a whole are similar to those explained with reference to FIG. 14 but are different from those explained with reference to FIG. 14 in the following points which are similar to those explained with reference to FIG. 18.

More specifically, a weakened line 21 is formed near one of the longitudinal edges 17*a* of the second sheet 17 in a perforating step 42 by means of a perforated line forming device 42A. After the dry sheet-like fibrous materials 12 are wrapped by the second sheet 17, the longitudinal edges 17*a* and 17*b* of which are overlapped, the overlapped edges are heat sealed in a center sealing step 43 by the center heat sealer 43A, the sealed portion being indicated by reference numeral 22.

Although the formation of the perforated line 21 is illustrated to take place just after the withdrawal of the second sheet 17 from the roll 17A in FIGS. 18 and 19, the location is not limited to the above-described position as long as it is before the wrapping of the sheet-like fibrous materials 12 by the second sheet 17.

The remaining constructions are similar to those in the embodiment explained with reference to FIG. 14.

ADVANTAGES OF THE INVENTION

The dispenser-container of the present invention containing wet tissues and tissue paper is compact and is convenient for portable use, and in addition, it can be easily handled because it has no hard flange portions, which are often observed in the conventional dispenser-container containing wet tissues and tissue paper. Further, the dispenser-container of the present invention is aesthetic.

The dispenser-container of the present invention is simple in its construction, and has a construction which is easy to be continuously manufactured at a low manufacturing cost.

If the second sheet is attached inside the bag as a partition in the dispenser-container of the present invention, the second sheet can be relatively thin, though the first sheet must be relatively thick because it is required to be liquid impervious and, more preferably, gas impervious. Accordingly, the cost of the sheets can be low. Furthermore, the obtained dispenser-container has an appearance similar to that of a conventionally known pillow type dispenser-container, and it is aesthetic and its shape is familiar to users.

If the second sheet is outside the bag in the dispenser-container of the present invention, the width of the second sheet is not limited by the width of the first sheet, and accordingly, the amount, i.e., the height, of the contents in a wet condition contained therein can be increased.

According to the process and apparatus of the present invention, the dispenser-container of the present invention can be easily and continuously manufactured, and accordingly, the cost for manufacturing the dispenser-container of the present invention can be inexpensive.

Besides, according to the process and apparatus of the present invention, the step for securely attaching the longitudinal edges of the second sheet and the first sheet can be done easily since the two sheets are attached before one of the sheets is formed in a pillow type bag. Further, if attaching operations are performed by heat sealing, heat can be easily transferred, and the heat sealing operation can be surely done.

What is claimed is:

1. A process for manufacturing a dispenser-container comprising:

feeding a liquid impervious continuous sheet having weakened lines for forming respective openings at a predetermined distance from each other, and having respective flexible flaps for resealably covering said openings;

feeding another liquid impervious continuous sheet in such a manner that it overlies said sheet having said flexible flaps;

supplying contents in a wet condition between said sheets before they completely overlie each other;

supplying contents in a dry condition in such manner that they overlie said contents in a wet condition, sandwiching said other sheet therebetween;

attaching both longitudinal edges of one of said sheets to the other sheet;

wrapping said contents in a dry condition by said other sheet along a longitudinal direction;

transversely sealing both said sheets; and transversely cutting said sheets.

2. A process for manufacturing a dispenser-container according to claim 1, wherein said other sheet has a longitudinal weakened line formed therein near one of the longitudinal edges thereof, and said longitudinal edges are sealed together after said contents in a dry condition are wrapped by said other sheet along a longitudinal direction thereof.

3. A process for manufacturing a dispenser-container comprising:

feeding a liquid impervious continuous sheet having weakened lines for forming respective openings at a predetermined distance from each other, and having respective flexible flaps for resealably covering said openings;

feeding another liquid impervious continuous sheet in such a manner that it overlies said sheet having said flexible flaps;

supplying contents in a wet condition between said sheets before they completely overlie each other;

supplying contents in a dry condition in such manner that they overlie said contents in a wet condition, sandwiching said other sheet therebetween;

attaching both longitudinal edges of one of said sheets to the other sheet;

wrapping said contents in a dry condition by said sheet with flaps along a longitudinal direction;

transversely sealing both said sheets; and transversely cutting said sheets.

4. A process for manufacturing a dispenser-container according to claim 3, wherein said sheet provided with said flaps further has a longitudinal weakened line formed therein near one of the longitudinal edges thereof, and said longitudinal edges are sealed together after said contents in a dry condition are wrapped by said sheet provided with flaps along a longitudinal direction thereof.

5. A process for manufacturing a dispenser-container comprising:

feeding a first continuous sheet of a liquid impervious material having weakened lines for forming respective openings therein at a predetermined distance from each other, and having respective flexible flaps for resealably covering said openings disposed thereon;

disposing contents in a wet condition at respective positions corresponding to said openings on the surface of said first sheet opposite to that provided with said flaps;

feeding a second continuous sheet of a liquid impervious material over said contents in a wet condition;

attaching both longitudinal edges of said second sheet to said first sheet;

disposing contents in a dry condition at respective positions corresponding to said contents in a wet condition, sandwiching said second sheet therebetween;

wrapping said contents in a wet condition, said second sheet and said contents in a dry condition by said first sheet to overlap the longitudinal edges of said first sheet;

transversely sealing transverse openings of said first and second sheets; and transversely cutting said first and second sheets.

6. A process for manufacturing a dispenser-container according to claim 5, which further comprises:

forming a weakened line extending in a straight line near one of the longitudinal edges of said first sheet; and sealing said longitudinal edges of said first sheet after wrapping said contents in a dry condition.

7. A process for manufacturing a dispenser-container comprising:

feeding a first continuous sheet of a liquid impervious material having weakened liens for forming respective openings therein at a predetermined distance from each other, and having respective flexible flaps for resealably covering said openings disposed thereon;

disposing contents in a wet condition onto a second continuous sheet of a liquid impervious material at respective positions;

overlaying said first sheet, exposing the surface provided with said flaps outside, onto said contents in a wet condition in such manner that said openings of said first sheet respectively correspond to said contents in a wet condition;

attaching both longitudinal edges of said second sheet to said first sheet;

disposing contents in a dry condition at respectively positions corresponding to said contents in a wet condition, sandwiching said second sheet therebetween;

wrapping said contents in a wet condition, said second sheet and said contents in a dry condition by said first sheet to overlap the longitudinal edges of said first sheet;

transversely sealing transverse openings of said first and second sheets; and transversely cutting said first and second sheets.

8. A process for manufacturing a dispenser-container according to claim 7, which further comprises:

forming a weakened line extending in a straight line near one of the longitudinal edges of said first sheet; and sealing said longitudinal edges of said first sheet after wrapping said contents in a dry condition.

9. A process for manufacturing a dispenser-container comprising:

feeding a first continuous sheet of a liquid impervious material having weakened lines for forming respective openings therein at a predetermined distance from each other, and having respective flexible flaps for resealably covering said openings disposed thereon;

disposing contents in a wet condition at positions corresponding to said openings onto a surface of said first continuous sheet opposite to that provided with said flaps;

overlaying a second sheet onto said contents;

attaching both longitudinal edges of said first sheet to said second sheet;

disposing contents in a dry condition at positions corresponding to said contents in a wet condition, sandwiching said second sheet therebetween;

wrapping said contents in a dry condition by said second sheet to overlap longitudinal edges of said second sheet;

transversely sealing transverse openings of said first and second sheets; and transversely cutting said first and second sheets.

10. A process for manufacturing a dispenser-container according to claim 9, which further comprises:

forming a weakened line extending in a straight line near one of longitudinal edges of said second sheet; and sealing said longitudinal edges of said second sheet after wrapping said contents in a dry condition.

11. A process for manufacturing a dispenser-container comprising:

feeding a first continuous sheet of a liquid impervious material having weakened lines for forming respective openings therein at a predetermined distance from each other, and having respective flexible flaps for resealably covering said openings disposed thereon;

disposing contents in a wet condition onto a surface of a second continuous sheet of a liquid impervious material;

overlaying said first sheet, exposing the surface provided with said flaps outside, onto said contents in a wet condition in such manner that said openings of said first sheet correspond to said contents in a wet condition;

attaching both longitudinal edges of said first sheet to said second sheet;

disposing contents in a dry condition at positions corresponding to said contents in a wet condition, sandwiching said second sheet therebetween;

wrapping said contents in a dry condition by said second sheet to overlap the longitudinal edges of said second sheet;

transversely sealing transverse openings of said first and second sheets; and transversely cutting said first and second sheet.

12. A process for manufacturing a dispenser-container according to claim 11, which further comprises:

forming a weakened line extending in a straight line near one of the longitudinal edges of said second sheet; and sealing said longitudinal edges of said second sheet after wrapping said contents in a dry condition.

13. A process for manufacturing a dispenser-container according to claim 5, 7, 9 or 11, wherein after said longitudinal edges are overlapped with each other, said longitudinal edges are slightly sealed with each other to such an extent that they can be manually separated.

14. A process for manufacturing a dispenser-container comprising:

feeding a first continuous sheet of a liquid impervious material having weakened lines for forming respective openings therein at a predetermined distance from each other, a weakened line extending in a straight line near one of the longitudinal edges of said first sheet, and respective flexible flaps for resealably covering said openings disposed thereon;

disposing contents in a wet condition at respective positions corresponding to said openings on the surface of said first sheet opposite to that provided with said flaps;

feeding a second continuous sheet of a liquid impervious material over said contents in a wet condition;

attaching both longitudinal edges of said second sheet to said first sheet;

disposing contents in a dry condition at respective positions corresponding to said contents in a wet condition, sandwiching said second sheet therebetween;

wrapping said contents in a wet condition, said second sheet and said contents in a dry condition by said first sheet to overlap the longitudinal edges of said first sheet;

sealing the longitudinal edges of said first sheet; transversely sealing transverse openings of said first and second sheets; and transversely cutting said first and second sheets.

15. A process for manufacturing a dispenser-container comprising:

feeding a first continuous sheet of a liquid impervious material having weakened lines for forming respective openings therein at a predetermined distance from each other, a weakened line extending in a straight line near one of the longitudinal edges of said first sheet, and respective flexible flaps for resealably covering said openings disposed thereon;

disposing contents in a wet condition onto a second continuous sheet of a liquid impervious material at respective positions;

overlaying said first sheet, exposing the surface provided with said flaps outside, onto said contents in a wet condition in such manner that said openings of said first sheet respectively correspond to said contents in a wet condition;

attaching both longitudinal edges of said second sheet to said first sheet;

disposing contents in a dry condition at respective positions corresponding to said contents in a wet condition, sandwiching said second sheet therebetween;

wrapping said contents in a wet condition, said second sheet and said contents in a dry condition by said first sheet o overlap longitudinal edges of said first sheet;

sealing said longitudinal edges of said first sheet;

transversely sealing transverse openings of said first and second sheets; and transversely cutting said first and second sheets.

16. A process for manufacturing a dispenser-container comprising:

feeding a first continuous sheet of a liquid impervious material having weakened lines for forming respective openings therein at a predetermined distance from each other and respective flexible flaps for resealably covering said openings disposed thereon;

disposing contents in a wet condition at positions corresponding to said openings on to a surface of said first continuous sheet opposite to that provided with said flaps:

overlaying a second sheet, having a weakened lien extending in a straight line near one of the longitudinal edges thereof, onto said contents;

attaching both longitudinal edges of said first sheet to said second sheet;

disposing contents in a dry condition at positions corresponding to said contents in a wet condition, sandwiching said second sheet therebetween;

wrapping said contents in a dry condition by said second sheet to overlap the longitudinal edges of said second sheet;

sealing said longitudinal edges of said second sheet;

transversely sealing transverse openings of said first and second sheets; and transversely cutting said first and second sheets.

17. A process for manufacturing a dispenser-container comprising:

feeding a first continuous sheet of a liquid impervious material having weakened liens for forming respective openings therein at a predetermined distance from each other and respective flexible flaps for resealably covering said openings disposed thereon;

disposing contents in a wet condition onto a surface of a second continuous sheet of a liquid impervious material at respective positions, said second sheet having a weakened line extending in a straight line near one of the longitudinal edges thereof;

overlaying said first sheet, exposing the surface provided with said flaps outside, onto said contents in a wet condition in such manner that said openings of said first sheet correspond to said contents in a wet condition;

attaching both longitudinal edges of said first sheet to said second sheet;

disposing contents in a dry condition at positions corresponding to said contents in a wet condition, sandwiching said second sheet therebetween;

wrapping said contents in a dry condition by said second sheet to overlap longitudinal edges of said second sheet;

sealing said longitudinal edges of said second sheet;

transversely sealing transverse openings of said first and second sheets; and transversely cutting said first and second sheets.

18. An apparatus for manufacturing a dispenser-container comprising:

means for feeding a first continuous sheet of a liquid impervious material;

means for feeding a second continuous sheet of a liquid impervious material;

said first sheet having weakened lines for forming openings at a predetermined distance from each other, sand having flexible flaps for resealably covering said openings, and said second sheet being without flaps;

means for supplying contents in a wet condition between said first sheet and said second sheet at the respective positions of said openings;

means for supplying contents in a dry condition on one of said sheets in such manner that they respectively overlie said contents in a wet condition, sandwiching the other sheet therebetween;

means for attaching both longitudinal edges of one of said sheets to the other sheet;

means for guiding said second sheet so as to wrap said contents in a dry condition by said second sheet along a longitudinal direction of said second sheet;

means for transversely sealing said sheets: and means for transversely cutting said sheets.

19. An apparatus for manufacturing a dispenser-container according to claim 18, which further comprises means for slightly sealing the longitudinal edges of said sheet wrapping said contents in a dry condition.

20. An apparatus for manufacturing a dispenser-container according to claim 18, which further comprises means for forming a longitudinally extending weakened line near one of said longitudinal edges of said sheet wrapping said contents in a dry condition.

21. An apparatus for manufacturing a dispenser-container according to claim 18 or 20, which further comprises means for sealing the longitudinal edges of said sheet wrapping said contents in a dry condition.

22. An apparatus for manufacturing a dispenser-container comprising:

means for feeding a first continuous sheet of a liquid impervious material;

means for feeding a second continuous sheet of a liquid impervious material;

said first sheet having weakened lines for forming openings at a predetermined distance from each other, and having flexible flaps for resealably covering said openings and said second sheet being without flaps;

means for supplying contents in a wet condition between said first sheet and said second sheet at the respective positions of said openings;

means for supplying contents in a dry condition in such manner that they respectively overlie said contents in a wet condition, sandwiching said second sheet therebetween;

means for attaching both longitudinal edges of said first sheet to said second sheet;

means for guiding said second sheet so as to wrap said contents in a dry condition by said second sheet along a longitudinal direction of said second sheet;

means for transversely sealing said sheets; and means for transversely cutting said sheets.

23. An apparatus for manufacturing a dispenser-container comprising:

means for feeding a first continuous sheet of a liquid impervious material;

means for feeding a second continuous sheet of a liquid impervious material;

said first sheet having weakened lines for forming openings at a predetermined distance from each other, and having flexible flaps for resealably covering said openings, and said second sheet being without flaps;

means for supplying contents in a wet condition between said first sheet and said second sheet at the respective positions of said openings;

means for supplying contents in a dry condition in such manner that they respectively overlie said contents in a wet condition, sandwiching said second sheet therebetween;

means for attaching both longitudinal edges of said second sheet to said first sheet;

means for guiding said first sheet so as to wrap said contents in a dry condition by said first sheet along a longitudinal direction of said first sheet;

means for transversely sealing said sheets; and means for transversely cutting said sheets.

* * * * *

UNITED STATES PATENT AND TRADEMARK OFFICE

CERTIFICATE OF CORRECTION

PATENT NO. : 5,161,350

DATED : November 10, 1992

INVENTOR(S) : K.Nakamura

It is certified that error appears in the above-identified patent and that said Letters Patent is hereby corrected as shown below:

Col. 5, line 14, after "sheet" change colon ":" to semi-colon --;--; line 43, after "sheet" change colon ":" to semi-colon --;--; line 45, after "sheets" change colon ":" to semi-colon --;--.

Col. 6, line 68 after "sheet" change colon ":" to semi-colon --;--.

Col. 7, line 4, after "sheets" change colon ":" to semi-colon --;--.

Col. 21, line 66, "liens" should read --lines--.

Col. 22, line 13, "respectively" should read --respective--.

Col. 24, line 38 change "on to" to read --onto--; line 40, after "flaps" change colon ":" to semi-colon --;--; line 41, change "lien" to read --line--; line 59, change "liens" to read --lines--.

UNITED STATES PATENT AND TRADEMARK OFFICE

CERTIFICATE OF CORRECTION

PATENT NO. : 5,161,350

DATED : November 10, 1992

INVENTOR(S) : K. Nakamura

It is certified that error appears in the above-identified patent and that said Letters Patent is hereby corrected as shown below:

Col. 25, line 26, change "sand" to read --and--; line 41, after "sheets" change colon ":" to semi-colon --;--.

Col. 26, line 12 after "openings" insert comma --,--.

Signed and Sealed this

Second Day of November, 1993

Bruce Lehman

*Attest:*

BRUCE LEHMAN

*Attesting Officer*

*Commissioner of Patents and Trademarks*